US011854349B2

(12) United States Patent
Fong

(10) Patent No.: US 11,854,349 B2
(45) Date of Patent: Dec. 26, 2023

(54) GAMING SYSTEM

(71) Applicant: Aristocrat Technologies Australia Pty Limited, North Ryde (AU)

(72) Inventor: Colin Fong, Sydney (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 235 days.

(21) Appl. No.: 16/930,676

(22) Filed: Jul. 16, 2020

(65) Prior Publication Data

US 2021/0295656 A1 Sep. 23, 2021

(30) Foreign Application Priority Data

Mar. 19, 2020 (AU) ..... 2020900836

(51) Int. Cl.
*G07F 17/00* (2006.01)
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/3258* (2013.01); *G07F 17/3239* (2013.01); *G07F 17/34* (2013.01)

(58) Field of Classification Search
None
See application file for complete search history.

(56) References Cited

U.S. PATENT DOCUMENTS

2007/0117607 A1* 5/2007 Olive ..... G07F 17/32 463/16

* cited by examiner

*Primary Examiner* — James S. McClellan
*Assistant Examiner* — Jeffrey K Wong
(74) *Attorney, Agent, or Firm* — Blank Rome LLP

(57) ABSTRACT

A gaming system that uses multiple ghost reels to trigger a jackpot feature. During the jackpot feature, a gaming system performs a first spin of a jackpot prize reel that includes multiple jackpot prize symbols. After the first spin, each of the displayed jackpot prize symbol replaces a jackpot symbol displayed on the same line of an adjacent first ghost reel. Afterwards, the gaming system performs a second spin of the jackpot prize reel that generates a second set of displayed jackpot prize symbols. The gaming system then replaces the jackpot symbols of an adjacent second ghost reel according to the displayed jackpot prize symbols located on the same line. If the jackpot prize symbols populated on the ghost reels and the jackpot prize reel produces a same line match, the gaming system awards a jackpot prize corresponding to the matched jackpot prize symbol.

20 Claims, 13 Drawing Sheets

426

| | | | |
|---|---|---|---|
| 460 | 1 | blank | 450 |
| 461 | 2 | Jackpot symbol | 452 |
| 462 | 3 | blank | 450 |
| 463 | 4 | blank | 450 |
| 464 | 5 | Jackpot symbol | 452 |
| 465 | 6 | blank | 450 |
| 466 | 7 | blank | 450 |
| 467 | 8 | Jackpot symbol | 452 |
| 468 | 9 | Jackpot symbol | 452 |
| 469 | 10 | Jackpot symbol | 452 |
| 470 | 11 | blank | 450 |
| 471 | 12 | blank | 450 |
| 472 | 13 | blank | 450 |
| 473 | 14 | Jackpot symbol | 452 |
| 474 | 15 | Jackpot symbol | 452 |

FIG. 4A

427

| | | | |
|---|---|---|---|
| 480 | 1 | GRAND | 454 |
| 481 | 2 | MINI | 455 |
| 482 | 3 | MAJOR | 456 |
| 483 | 4 | MINOR | 457 |
| 484 | 5 | MAJOR | 456 |
| 485 | 6 | MINI | 455 |
| 486 | 7 | MINOR | 457 |
| 487 | 8 | MINI | 455 |
| 488 | 9 | MAJOR | 456 |
| 489 | 10 | MINI | 455 |

FIG. 4B

400

| | | Reel 1 (421) | Reel 2 (422) | Reel 3 (423) | Reel 4 (424) | Reel 5 (425) |
|---|---|---|---|---|---|---|
| 401 | 1 | K | 10 | J | A | 10 |
| 402 | 2 | SCAT | SCAT | SCAT | SCAT | SCAT |
| 403 | 3 | SCAT | SCAT | SCAT | SCAT | SCAT |
| 404 | 4 | SCAT | SCAT | SCAT | SCAT | SCAT |
| 405 | 5 | K | 10 | PIC1 | PIC2 | Q |
| 406 | 6 | 10 | PIC3 | PIC3 | K | PIC4 |
| 407 | 7 | PIC2 | PIC1 | A | PIC3 | K |
| 408 | 8 | PIC4 | PIC4 | PIC4 | Q | PIC3 |
| 409 | 9 | PIC1 | Q | K | WILD | A |
| 410 | 10 | J | PIC2 | PIC2 | WILD | PIC1 |
| 411 | 11 | Q | A | WILD | WILD | PIC2 |
| 412 | 12 | PIC2 | PIC3 | WILD | WILD | PIC3 |
| 413 | 13 | J | J | WILD | WILD | WILD |
| 414 | 14 | PIC4 | WILD | WILD | WILD | WILD |
| 415 | 15 | Q | WILD | WILD | WILD | WILD |
| 416 | 16 | K | WILD | WILD | WILD | WILD |
| 417 | 17 | PIC3 | WILD | WILD | WILD | WILD |
| 418 | 18 | A | WILD | WILD | PIC2 | WILD |
| 419 | 19 | J | WILD | WILD | PIC1 | WILD |
| 420 | 20 | PIC1 | WILD | 10 | A | WILD |
| 421 | 21 | A | WILD | PIC1 | K | WILD |
| 422 | 22 | PIC2 | WILD | Q | SCAT | J |
| 423 | 23 | Q | Q | PIC4 | J | PIC1 |
| 424 | 24 | PIC3 | PIC4 | 10 | PIC4 | 10 |
| 425 | 25 | 10 | A | SCAT | 10 | SCAT |
| 426 | 26 | PIC4 | K | Q | PIC3 | K |
| 427 | 27 | A | SCAT | PIC3 | Q | J |
| 428 | 28 | PIC3 | J | K | PIC1 | PIC2 |
| 429 | 29 | 10 | PIC2 | PIC2 | 10 | A |
| 430 | 30 | SCAT | K | J | PIC4 | PIC4 |
| 431 | 31 | PIC1 | PIC1 | A | J | Q |

438 434 436 432 438

446 444 442

FIG. 4C

GAMING SYSTEM

CROSS REFERENCE TO RELATED APPLICATIONS

This application claims priority to Australian Provisional Patent Application Serial No. 2020900836, filed Mar. 19, 2020 and entitled "A Gaming System," which is incorporated by reference herein in its entirety.

FIELD

The disclosure relates generally to the field of user interface (UI) design, electronic gaming machines (EGMs) and other electronic gaming devices, and electronic gaming software. More particularly, but not by way of limitation, this disclosure relates to performing gaming device operations that present and implement a ghost reel mechanic for a random based game outcome.

BACKGROUND

EGMs or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus game of the base game by attaining a certain winning combination or triggering event in, or related to, the base game, or after the player is randomly awarded the special mode, secondary game, or bonus game. In the special mode, secondary game, or bonus game, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game (also referenced throughout the disclosure as a "random based game outcome"), Examples of random based game outcomes include slots, video poker, video blackjack, video pachinko, keno, bingo, and lottery outcomes. The games are also designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

EGMs often depend on usability (e.g., ease of use and player understandability) and new or improved game features to enhance player experiences on the EGMs. Although previous EGMs include various UI features, game features, and game processing operations associated with the UI features to improve usability and enhance player experiences, there is a continuous need for further improvement to EGMs and other electronic gaming devices, electronic gaming software, and/or UI design.

SUMMARY

In one implementation, a gaming system is described that uses multiple ghost reels to trigger a jackpot feature when a matching number of jackpot symbols appear on the ghost reels. During the jackpot feature, a gaming system performs a first spin of a jackpot prize reel that includes multiple jackpot prize symbols, such as MINI, MINOR, MAJOR or GRAND symbols. After the first spin of the jackpot prize reel, each of the displayed jackpot prize symbol replaces a jackpot symbol displayed on the same line of an adjacent first ghost reel. Afterwards, the gaming system performs a second spin of the jackpot prize reel that generates a second set of displayed jackpot prize symbols. The gaming system then replaces one or more jackpot symbols of an adjacent second ghost reel according to the displayed jackpot prize symbols located on the same line. If the jackpot prize symbols populated on the ghost reels and the jackpot prize reel produces a same line match, the gaming system awards a jackpot prize corresponding to the matched jackpot prize symbol.

In another implementation, a gaming system is also described that uses one or more ghost reels to trigger a jackpot feature from a base or feature game. The gaming system includes a first ghost reel and a second ghost reel, where the random based game outcomes the ghost reels are independent of the random based game outcomes of the reels of the base or feature game. Each ghost reel rotates over and in sync with a base or feature game reel to provide an impression that the random based game outcome of the ghost reel is related to the random based game outcome of the underlying reels of the base or feature game.

In another implementation, gaming system is disclosed that comprises at least one display, and a game controller that includes at least one processor and at least one memory device. The at least one processor, the at least one memory device, and the at least one display are operably connected. The at least one memory device stores computer-readable instructions for controlling the at least one processor to implement a non-jackpot feature that triggers a jackpot feature in response to satisfying a triggering event that occurs during the non-jackpot feature. For each jackpot feature, the processor is controlled to select and display at least one jackpot prize symbol from a jackpot prize reel on at least one respective jackpot prize reel display position. The jackpot prize reel includes a plurality of jackpot prize symbols, each jackpot prize symbol indicative of a jackpot prize. The processor is also controlled to populate each selected jackpot prize symbol to a displayed first symbol group, select at least one further jackpot prize symbol from the jackpot reel for display on at least one respective jackpot prize reel display position, and populate at least one further selected jackpot prize symbol to a displayed second symbol group. The processor is also controlled to determine whether a jackpot winning condition exists based on a comparison of the jackpot prize symbols in the first and second symbol groups, and award a jackpot prize to a player when the determination is that a jackpot winning condition exists.

In another implementation, a method for performing gaming device operations is also disclosed that comprises implementing a non-jackpot feature that triggers a jackpot feature based on satisfying a triggering event in the non-jackpot feature. For each jackpot feature, the method includes, for a first reel spin, selecting and displaying at least one jackpot prize symbol from a jackpot prize reel for one or more jackpot prize reel display positions. The jackpot prize reel includes a plurality of jackpot prize symbols, where each jackpot prize symbol is indicative of a jackpot prize. For the jackpot feature, the method populates each selected jackpot prize symbol to a displayed first symbol group and subsequently performs a second reel spin. The second reel spin produces a second set of jackpot prize symbols to be displayed on the jackpot prize reel display positions. Based on the second reel spin, the method selects one or more jackpot prize symbols from the second set of jackpot prize symbols and populates the jackpot prize symbols to a displayed second symbol group. The method also determines whether a jackpot winning condition exists based on a comparison of the jackpot prize symbols in the first and second symbol groups, and awards a jackpot prize amount to a player based on a determination that a jackpot winning condition exists.

In another implementation, a gaming system is also disclosed that includes at least one display, and a game controller that includes at least one processor and at least one memory device. The at least one processor, the at least one memory device, and the at least one display are operably connected. The at least one memory device stores computer-readable instructions for controlling the at least one processor to implement a first game type in a first game and trigger a second game with a second game type in response to a triggering event occurring during the first game. The second game type differs from the first game type. The processor is also controlled to display at least one ghost reel display position for at least one ghost reel, where each ghost reel includes at least one trigger symbol and a plurality of blank symbols. The processor disposes each ghost reel over an underlying game reel of the first game, rotate the at least one ghost reel in synchronization with rotation of the underlying game reel of the first game, and select at least one trigger symbol and/or blank symbol at multiple ghost reel display position. The selection and display of at least one trigger symbol and/or blank symbol are independent of the outcomes generated from the underlying game reel of the first game. The triggering event includes selection and display of a defined outcome at the ghost reel display positions of the at least one ghost reel.

In another implementation, a method for performing gaming device operations is also disclosed that comprises implementing a first game of first game type, and triggering a second game of second game type different to the first game type in response to a triggering event occurring during the first game. The method also includes displaying at least one ghost reel display position for at least one ghost reel, each ghost reel including at least one trigger symbol and a plurality of blank symbols, disposing each ghost reel over a game reel of the first game, rotating the at least one ghost reel in synchronization with rotation of a game reel of the first game, and selecting a trigger symbol or blank symbol at each ghost reel display position. Selection and display of at least one trigger symbol or blank symbol is independent of outcomes of the first game, and the triggering event comprises selection and display of a defined outcome at the ghost reel display positions of the at least one ghost reel.

In one implementation, each of the above described methods, gaming systems, and variations thereof, may be implemented as a series of computer executable instructions executed on a programmable electronic device. Such instructions may use any one or more convenient programming language, Such instructions may be collected into engines and/or programs and stored in any computer-readable medium or media that is readable and executable by a computer system, mobile device, or other programmable electronic device.

BRIEF DESCRIPTION OF THE DRAWINGS

FIG. 4A illustrates an example of a ghost reel strip layout.

FIG. 4B illustrates an example of a jackpot prize reel strip layout

FIG. 4C illustrates an example an underlying reel strip layout in a base or feature game.

DETAILED DESCRIPTION

Figure 1:
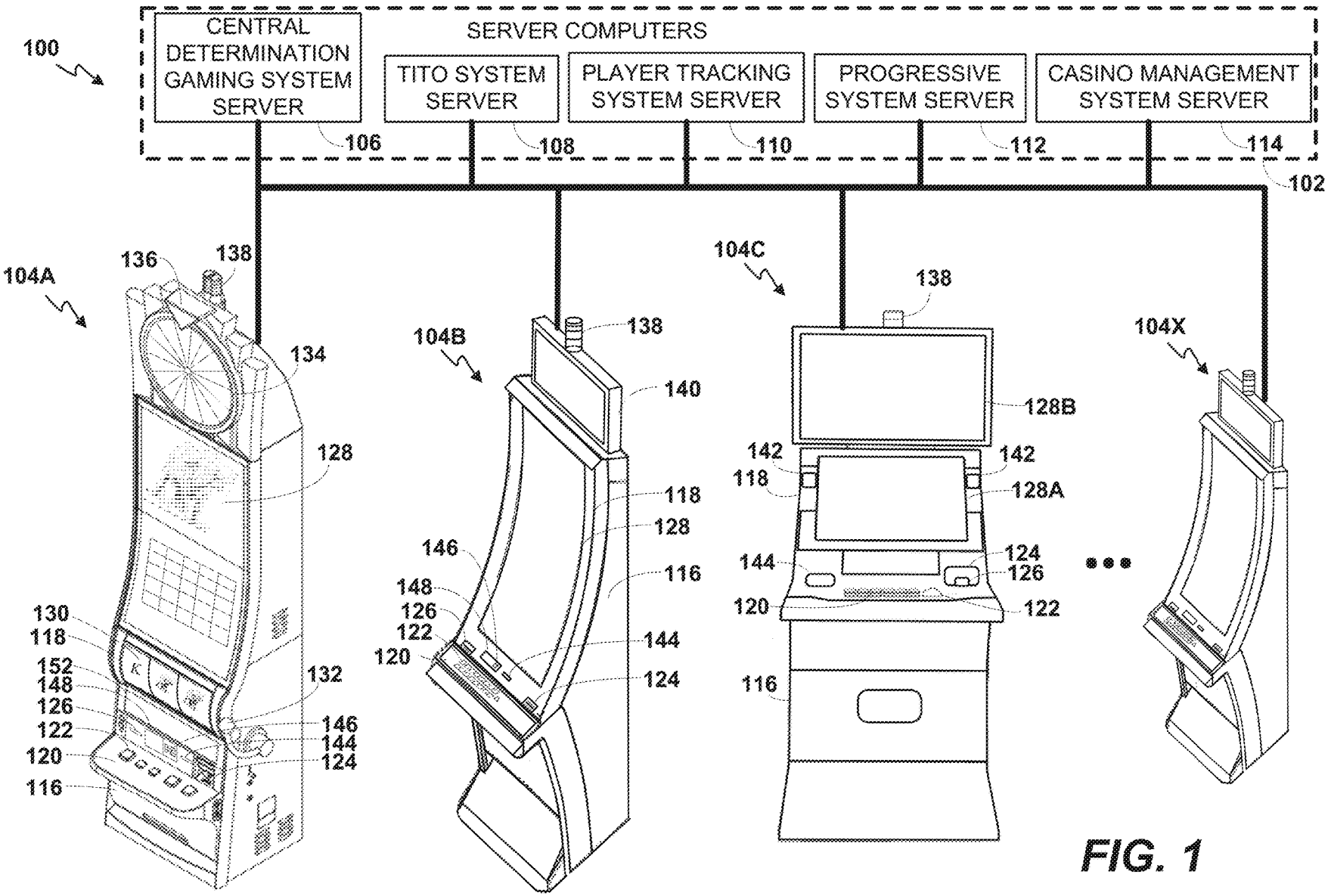
FIG. 1 is an exemplary diagram showing several EGMs networked with various gaming related servers.

The disclosure includes various example implementations that generate a random based game outcome according to a ghost reel mechanic. In one or more implementations, a gaming device provides one or more ghost reels within a base and/or feature game (e.g., a special mode, secondary game, or bonus game). The one or more ghost reels generate random based game outcomes that determine whether to trigger a jackpot feature. When presenting the ghost reels within a user interface (e.g., on one or more display devices), the gaming device overlays and rotates the ghost reels over underlying reels for the base or feature game. Specifically, the ghost reels rotate in sync to provide an impression that the random based game outcome from the ghost reels is related to the random based game outcome of the underlying reels. Although the ghost reels and underlying reels appear related, the gaming device generates separate and independent random based game outcomes for the ghost reels and underlying reels. As an example, the gaming device could be programmed to provide two ghost reels, where a first ghost reel overlays on top of reel one of the base or feature game and a second ghost reel overlays on top of reel five of the base or feature game. The two ghost reels are combined to generate a random based game outcome that determines whether to trigger a jackpot feature. In this example, the trigger condition for the jackpot feature is based on the total number of jackpot symbols that land on both ghost reels. The five underlying reels of the base or feature game generates another random based game outcome that has no effect on whether to trigger the jackpot feature.

In a jackpot feature, the gaming devices presents and uses the same ghost reels and/or jackpot symbols that trigger the jackpot feature. In one or more implementations, the gaming device positions the ghost reels in the same reel positions as when utilized in the base or feature game. The gaming device also presents the same number of jackpot symbols in the ghost reels that triggered the jackpot feature. For example, if ghost reels were overlaid over reel one and reel five in the base or feature game, the gaming device presents the ghost reels in the same reel positions in the jackpot feature. Furthermore, if six jackpot symbols land within the ghost reels to trigger the jackpot feature, then the gaming device would present the same number of jackpot symbols (e.g., six jackpot symbols) for the jackpot feature.

In addition to the ghost reels, the jackpot feature includes a different game type than the base or feature game. Rather than utilizing the underlying reels of the base or feature game, the jackpot feature uses a jackpot prize reel that includes multiple jackpot prize symbols, such as MINI, MINOR, MAJOR, and/or GRAND symbols. For a first spin, the gaming device determines a reel stop for the jackpot prize reel. After determining the reel stop for the jackpot prize reel, the gaming device propagates the jackpot prize symbols that land to the jackpot symbols in a first ghost reel (e.g., ghost reel in reel position 1); thereby, updating the jackpot symbols with jackpot prizes and/or other award values. By doing so, the first ghost reel displays and/or stores the random based game outcome for the first spin of the jackpot prize reel. The gaming device then automatically initiates a second spin and determines a second reel stop for the jackpot prize reel. The gaming device propagates the jackpot symbol in the other ghost reel (e.g., ghost reel in reel position 5) with the jackpot prize symbols that land on the jackpot prize feel. If the ghost reels and/or jackpot prize reel produce a line match for certain jackpot prize symbols, the gaming device awards the jackpot awards associated with the matched jackpot prize symbols.

In terms of technical effects, the ghost reel mechanic delivers improvements to the UI design of a gaming device by providing new and/or improved gaming device operations that comply with gaming regulations. For UI focused operations, presenting the ghost reel mechanic can provide additional game flexibility, improve the usability of the gaming devices, enhance a player's understandability of obtaining certain game outcomes, and provide another approach to presenting how a player could build equity in a game while complying with gaming regulations. In one example, presenting (e.g., overlaying and synchronizing) one or more ghost reels within a base and/or feature game improves usability and flexibility of the gaming device by allowing the same ghost reels to be applied across different features and/or games. In addition, by synchronizing the ghost reel with the underlying reels of a base game, the game can display two game outcomes for a given spin. In another example, when transitioning to the jackpot feature, the UI focused operations also presents how random based game outcomes that the ghost reels produce in a base or feature game are held and transferred to the jackpot feature. During the jackpot feature, the UI focused operations utilize the jackpot symbols that trigger the jackpot feature to present and depict how the gaming device uses prior and/or current spins of a jackpot prize reel to determine a jackpot prize.

With respect to improvements to the electronic gaming software and/or gaming device, the ghost reel mechanic delivers new and/or improved gaming device operations. Specifically, the gaming device is specially programmed to implement a ghost reel mechanic in a computationally effective manner that complies with gaming regulations. In one example, to achieve a target RTP that complies with gaming regulations, the specially programmed gaming device controls the triggering frequency of a jackpot feature by utilizing different sets of reels that simultaneously spin for a given spin. Rather than switching out or replacing reel strips in base or feature game, the underlying reels of the base or feature game can remain unmodified since the outcome of the underlying reels is independent and has no effect on when to trigger the jackpot feature. To independently determine whether to trigger the jackpot, the gaming devices evaluates the random based game outcome generated from the ghost reels. In addition to avoiding the need to replace reel strips, the ghost reel mechanic also allows the same jackpot triggering mechanic to be applied to multiple games that could have varying UI characteristics, such as different symbol display grid or matrix sizes. For example, the same ghost reels can be applied to a base game that presents a 5×3 symbol display grid and a feature game that presents a 6×3 symbol display grid. Additionally, or alternatively, having ghost reels in the jackpot feature allows the gaming device to effectively evaluate different random based game outcomes produced from multiple spins. These and other technical features are described in greater detail later in the disclosure.

Example Electronic Gaming Servers, Gaming Devices, and Gaming Environments

FIG. 1 illustrates several different models of EGMs that could be specially configured to generate random based game outcomes using a ghost reel mechanic. As shown in FIG. 1, the EGMs, which are more generally referred to as gaming devices 104A-104X, may be networked to various gaming related servers. Shown is a system 100 in a gaming environment including one or more server computers 102 (e.g., slot servers of a casino) that are in communication, via a communications network, with one or more gaming devices 104A-104X (e.g., EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi i®) and Bluetooth®), cable TV, satellite links and the like.

In some implementation, server computers 102 may not be necessary and/or preferred. For example, in one or more implementations, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The mechanical reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution liquid crystal display (LCD), plasma, light emitting diode (LED), or organic light emitting diode (OLED) panel which may be flat or curved as shown, a cathode ray tube, or other conventional electronically controlled video monitor.

In some implementations, the bill validator 124 may also function as a "ticket-in" reader that allows the player to use a casino issued credit ticket to load credits onto the gaming device 104A (e.g., in a cashless TITO system). In such cashless implementations, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A, The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some implementations, a player tracking card reader 144, a transceiver for wireless communication with a mobile device (e.g., a player's smartphone), a keypad 146, and/or an illuminated display 148 for reading, receiving, entering, and/or displaying player tracking information is provided in gaming device 104A. In such implementations, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.01 or $0.05), paylines, pay tables, and/or various game related graphics. In some implementations, the information panel(s) 152 may be implemented as an additional video display.

Figure 2:
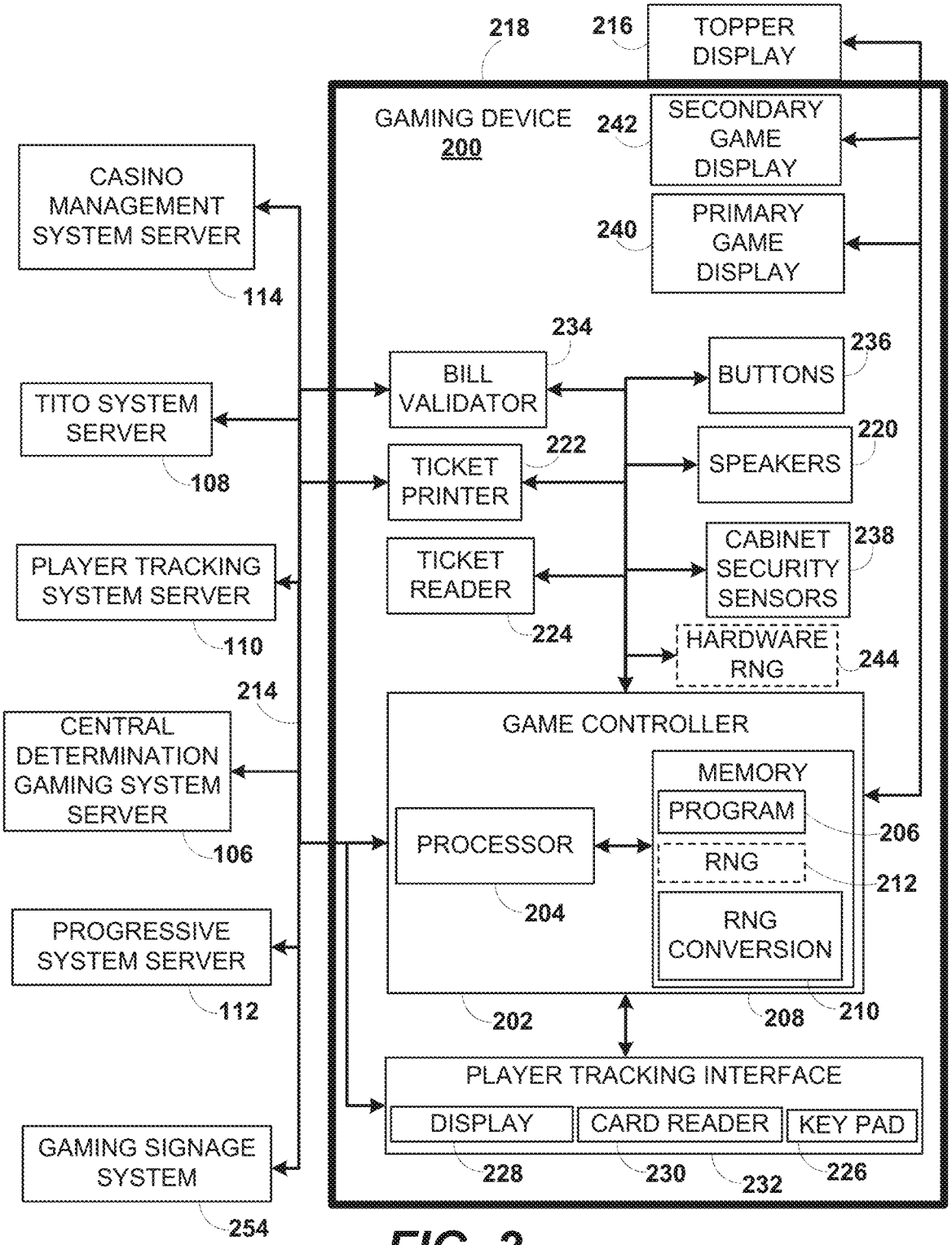
FIG. 2 is a block diagram showing various functional elements of an exemplary EGM.

Gaming devices 104A have traditionally also included a handle 132 typically mounted to the side of main cabinet 116 which may be used to initiate game play. Many or all the above described components can be controlled by circuitry (e.g., a game controller) housed inside the main cabinet 116 of the gaming device 104A, the details of which are shown in FIG. 2.

An alternative example gaming device 104B illustrated in FIG. 1 is the Arc™ model gaming device manufactured by Aristocrat® Technologies, Inc. Note that where possible, reference numerals identifying similar features of the gaming device 104A implementation are also identified in the gaming device 104B implementation using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some implementations, the optional topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the main display 128A may have a curvature radius from top to bottom, or alternatively from side to side. In some implementations, main display 128A is a flat panel display. Main display 128A is typically used for primary game play while secondary display 128B is typically used for bonus game play, to show game features or attraction activities while the game is not in play or any other information or media desired by the game designer or operator. In some implementations, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the gaming device 200 shown could be used to implement any one of the example gaming devices 104A-X depicted in FIG. 1. Similar to FIG. 1, gaming device 200 can be specially configured to generate random based game outcomes using a repeat accrual meter mechanic. As shown in FIG. 2, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2 illustrates that game controller 202 includes a single processor 204, game controller 202 is not limited to this representation and instead can include multiple processors 204 (e.g., two or more processors).

FIG. 2 illustrates that processor 204 is operatively coupled to memory 208. Memory 208 is defined herein as including volatile and nonvolatile memory and other types of non-transitory data storage components. Volatile memory is memory that does not retain data values upon loss of power, Nonvolatile memory is memory that does retain data upon a loss of power. Examples of memory 208 include random access memory (RAM), read-only memory (ROM), hard disk drives, solid-state drives, universal serial bus (USB) flash drives, memory cards (e.g., Compact Fast (CFast) memory card), floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2 illustrates that game controller 202 includes a single memory 208, game controller 202 could include multiple memories 208 for storing program instructions and/or data.

Memory 208 can store one or more game programs 206 that provide program instructions and/or data for carrying out various implementations (e.g., game mechanics) described herein. Stated another way, game program 206 represents an executable program stored in any portion or component of memory 208. In one or more implementations, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchanges with one or more remote gaming devices, such as a central determination gaming system server 106 (not shown in FIG. 2 but shown in FIG. 1). For purpose of this disclosure, the term "game instance" refers to a play or a round of a game that gaming device 200 presents (e.g., via UI) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2 illustrates that gaming device 200 could include an RNG 212 that utilizes hardware and/or software to generate RNG outcomes that lack any pattern. The RNG operations are often specialized and non-generic in order to comply with regulatory and gaming requirements. For example, in a slot game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more implementations, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred throughout this disclosure as a "random number").

In FIG. 2, RNG 212 and hardware RNG 244 are shown in dashed lines to illustrate that RNG 212, hardware RNG 244, or both can be included in gaming device 200. In one implementation, instead of including RNG 212, gaming device 200 could include a hardware RNG 244 that generates RNG outcomes, Analogous to RNG 212, hardware RNG 244 performs specialized and non-generic operations in order to comply with regulatory and gaming requirements. For example, because of regulation requirements, hardware RNG 244 could be a random number generator that securely produces random numbers for cryptography use. The gaming device 200 then uses the secure random numbers to generate game outcomes for one or more game features (e.g., bonus game, special mode, secondary game, and/or other supplemental game features). In another implementation, the gaming device 200 could include both hardware RNG 244 and RNG 212. RNG 212 may utilize the RNG outcomes from hardware RNG 244 as one of many sources of entropy for generating secure random numbers for the game features.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables (also referenced throughout this disclosure as "weighted tables") as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts. Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2 illustrates that gaming device 200 includes an RNG conversion engine 210 that translates the RNG outcome from RNG 212 to a game outcome presented to a player. To meet a designated RTP, a game developer can set up the RNG conversion engine 210 to utilize one or more lookup tables and/or reel strips to translate the RNG outcome to a symbol element, stop position for a reel strip, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table and/or reel strips to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2 also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment, and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming device. The credit balance is used by the player to place wagers on instances of the game and to receive game credit awards based on the outcome of winning instances. The credit balance is decreased by the amount of each wager and increased upon a win. The player can add additional game credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus game or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Additionally, or alternatively, gaming devices 104A-104X and 200 can include or be coupled to one or more wireless transmitters, receivers, and/or transceivers (not shown in FIGS. 1 and 2) that communicate (e.g., Bluetooth® or other near-field communication technology) with one or more mobile devices to perform a variety of wireless operations in a casino environment. Examples of wireless operations in a casino environment include detecting the presence of mobile devices, performing credit, points, comps, or other marketing or hard currency transfers, establishing wagering sessions, and/or providing a personalized casino-based experience using a mobile application. In one implementation, to perform these wireless operations, a wireless transmitter or transceiver initiates a secure wireless connection between a gaming device 104A-104X and 200 and a mobile device. After establishing a secure wireless connection between the gaming device 104A-104X and 200 and the mobile device, the wireless transmitter or transceiver does not send and/or receive application data to and/or from the mobile device. Rather, the mobile device communicates with gaming devices 104A-104X and 200 using another wireless connection (e.g., WiFi® or cellular network). In another implementation, a wireless transceiver establishes a secure connection to directly communicate with the mobile device. The mobile device and gaming device 104A-104X and 200 sends and receives data utilizing the wireless transceiver instead of utilizing an external network. For example, the mobile device would perform digital wallet transactions by directly communicating with the wireless transceiver. In one or more implementations, a wireless transmitter could broadcast data received by one or more mobile devices without establishing a pairing connection with the mobile devices.

Although FIGS. 1 and 2 illustrate specific implementations of a gaming device (e.g., gaming devices 104A-104X and 200), the disclosure is not limited to those implementations shown in FIGS. 1 and 2. For example, not all gaming devices suitable for implementing implementations of the present disclosure necessarily include top wheels, top boxes; information panels, cashless ticket systems, and/or player tracking systems. Further, some suitable gaming devices have only a single game display that includes only a mechanical set of reels and/or a video display, while others are designed for bar counters or tabletops and have displays that face upwards. Gaming devices 104A-104X and 200 may also include other processors that are not separately shown. Using FIG. 2 as an example, gaming device 200 could include display controllers (not shown in FIG. 2) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Ghost Reels Mechanic

Figure 3:
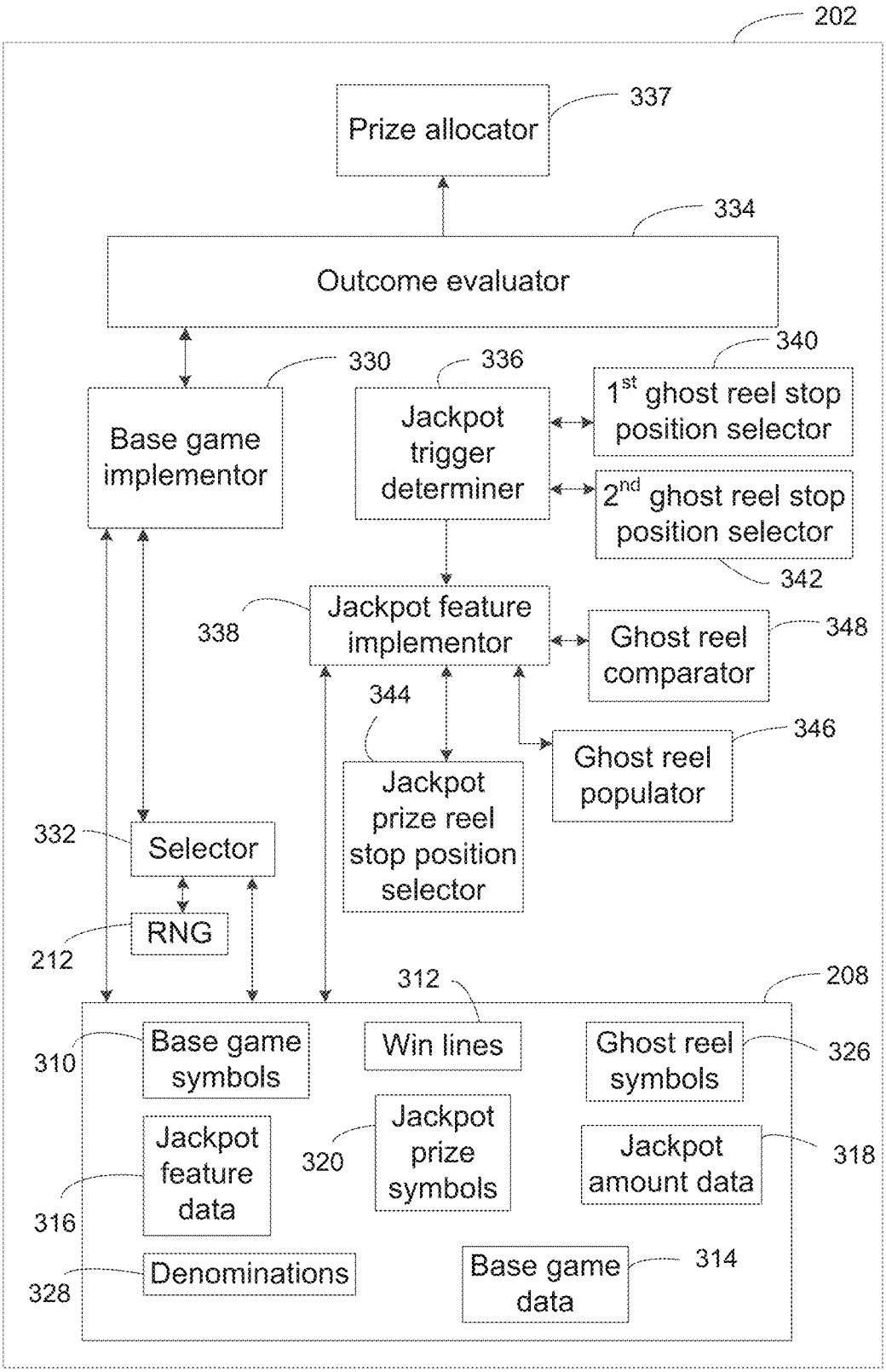
FIG. 3 is a block diagram showing functional components that perform a ghost reel mechanic implemented by a gaming device.

FIG. 3 illustrates an example block diagram showing functional components used to implement a ghost reel mechanic with a gaming device. Using FIG. 2 as an example, the functional components could be implemented by a game controller 202 within gaming device 200. The functional components comprise data stored in the memory 208, including data indicative of base game symbols data 310; data indicative of win lines 312; base game data 314 defining characteristics of a base game; jackpot feature data 316 defining characteristics of a jackpot feature, including jackpot feature games, and characteristics of accumulation of jackpots; and jackpot amount data 318 indicative of jackpots amounts. The memory 208 also includes jackpot prize symbol data 320 indicative of defined jackpot prize symbols, ghost reel symbol data 326 indicative of jackpot symbols on two or more ghost reels, and denomination data 328 indicative of available denomination amounts. For purposes of this disclosure, the term "ghost reel" refers to a reel that overlays onto one or more underlying or existing reels of a game.

The functional components also include a base game implementer 330 arranged to implement base games using a selector 332 to select base game symbols using the base game symbols data 310 for display at a plurality of symbol positions in a symbol array using the RNG 212. Outcomes of a base game are determined by an outcome evaluator 334 and any applicable prize is awarded by a prize allocator 337, for example based on a base game pay table.

The functional components also include a jackpot trigger determiner 336 arranged to decide whether to commence a jackpot feature based on a triggering event occurring during a base game. As shown in FIG. 3, the outcome evaluator 334 and jackpot trigger determiner 336 utilize separate inputs to determine the outcomes. In particular, the jackpot trigger determiner 336 obtains data from the first ghost reel stop position selector 340 and the second ghost reel stop position selector 342 while the base game implementor 330 provides data to the outcome evaluator 334.

In FIG. 3, the gaming device 200 includes standard reels (e.g., underlying reels of a base game) that include symbols usable to determine base and/or feature game outcomes, and one or more ghost reels (e.g., non-standard reels) that are used to determine whether a jackpot feature trigger condition has occurred. Generally, the triggering event may be a selection and display of a defined number of trigger symbols, such as jackpot symbols, in at least one ghost reel during a non-jackpot feature, such as a base or feature game. FIG. 3 illustrates that jackpot trigger determiner 336 combines and evaluates whether a trigger condition occurs based on the selection and display of a number of trigger symbols in a first ghost reel and selection and display of a matching number of trigger symbols in a second ghost reel. The game controller 302 can use a variety of suitable trigger conditions and/or symbol types when determining whether to trigger a jackpot feature using the ghost reels.

While the present example is described in relation to a jackpot feature that is triggered in response to occurrence of a jackpot trigger during a base game, it will be understood that the jackpot feature may be caused to trigger from any suitable game, for example during a feature game implemented in response to a feature trigger occurring during a base game.

In the present example, the jackpot triggering mechanic and jackpot feature are implemented by a jackpot feature implementor 338 using a first ghost reel stop position selector 340, a second ghost reel stop position selector 342, a jackpot prize reel stop position selector 344, a ghost reel populator 346, and a ghost reel comparator 348. As shown in FIG. 3, the jackpot trigger determiner 336 is independent of random based game outcomes generated for base game. As previously discussed, although the random based game outcomes are separate and independent, the game controller 302 could generate a UI that appears to relate the normal game play with ghost reels that include jackpot symbols that rotate and stop in synchronization with normal game reels. In this way, the same jackpot mechanism can be applied to multiple games, each with different base or feature game UI layouts. As an example, the ghost reels could be applied to a base game and/or a feature game where the symbol display grid or matrix sizes for presenting symbol differ. For illustrative purposes, the base game could present a 5×3 symbol display grid while a feature game presents a 6×3 symbol display grid.

In the present embodiment, two ghost reels are provided, with each ghost reel associated with and arranged to rotate in synchronization with a game reel (also referenced as an "underlying reel" within this disclosure). As previously described, by having the ghost reels rotate in synchronization with the game reel, the game controller 302 can generate two different random based game outcomes for a given spin. In this example, the ghost reels are caused to spin when the game reels spin during a base game or feature game, and the jackpot feature is triggered when a defined or matching number of jackpot symbols, are selected and displayed in both of the first and second ghost reels.

With reference to FIG. 4A as an example, each ghost reel strip 426 represents a symbol group with fifteen reel strip positions 460-474 and seven jackpot symbols 452 for triggering a jackpot feature. The ghost reel includes two jackpot symbols 452 not in any stacks (at reel strip positions 461 and 464), three jackpot symbols 452 in a first stack (at reel strip positions 467, 468, and 469), two jackpot symbols 452 in a second stack (reel strip positions 473 and 474) and eight blank symbols 450 at the remaining reel strip positions 460, 462, 463, 465, 466, 470, 471, and 472. In one or more implementations, the jackpot symbols 452 are not assigned a jackpot prize or other award value. The reel stop of the first ghost reel is controlled by the first ghost reel stop position selector 340, and the reel stop of the second ghost reel is controlled by the second ghost reel stop position selector 342. Although not explicitly shown in FIG. 3, the first ghost reel stop position selector 340 and the second ghost reel stop position selector 342 could determine a reel stop based on random numbers generated from RNG 212 and/or one or more reel stopping position tables. Additionally, or alternatively, the game controller could utilize other ghost reel stop position selectors for other ghost reels. For purposes of this disclosure, the term "reel stop" generally refers to where a reel lands or stops for a given spin when producing a random based game outcome.

The jackpot prize amount associated with a jackpot may be a defined prize amount, such as an amount equal to the amount of credits bet multiplied by 1, 2, 3, 4, 5, 8, 10, 15, 20, 25, 30, 50, 100, 200 or 250, or may be an amount derived from a bonus pool and/or progressive jackpot pool. In this example, four different bonus prizes—MINI, MINOR, MAJOR and GRAND—are provided of increasing size, with each bonus prize being dependent on the selected bet denomination, such that the magnitude of the bonus prize increases with increasing bet denomination.

As shown in FIG. 3, the jackpot feature implementor 338 and base game implementor 330 are shown to be separate functional components. In one or more implementations, based on being separate functional components, the jackpot feature implementor 338 generates a different game type than what the base game implementor 330 generates. As an example, rather than using standard reels, the jackpot feature implementator 338 utilizes a jackpot prize reel. With reference to FIG. 3, outcomes of the jackpot feature are determined using the jackpot prize reel, the jackpot prize reel stop position selector 344, the ghost reel populator 346 and the ghost reel comparator 348. The jackpot prize reel includes several jackpot prize symbols, in this example indicia indicative of the jackpot type—MINI, MINOR, MAJOR and GRAND. With reference to FIG. 4B as an example, a jackpot prize reel strip 427 could have ten reel strip positions 480-489 and ten jackpot prize symbols 454, 455, 456, and 457. FIG. 4B depicts the jackpot prize reel strip 427 includes four MINI jackpot prize symbols 455 located at reel strip positions 481, 485, 487, and 489, two MINOR jackpot prize symbols 457 at reel strip positions 483 and 486, two MAJOR jackpot prize symbols 456 at reel strip positions 482 and 488, and one GRAND jackpot prize symbol 454 at reel strip position 480.

At commencement of a jackpot feature of the jackpot feature, jackpot symbols are shown on the ghost reels, and the jackpot prize reel is caused to spin and stop at a first reel stop according to a random number generated by the RNG 212 and one or more reel stopping position tables that match RNG generated numbers to jackpot prize reel stopping positions. After determining the first reel stop for the jackpot prize reel, jackpot prize symbols are displayed at one or more jackpot prize reel display positions. The ghost reel populator 346 causes the jackpot prize symbols displayed at the jackpot prize reel display positions to replace, update, and/or populate the jackpot symbols of one of the ghost reels. In other words, the ghost reel populator 346 records and displays the first random based game outcome of the jackpot prize reel onto one of the ghost reels. The jackpot prize reel is then caused to spin again and stop at a second reel stop, and the ghost reel populator 346 causes the jackpot prize symbols displayed at the jackpot prize reel display positions to also replace, update, and/or populate the jackpot symbols of another ghost reel. By doing so, the ghost reel records and displays the second random based game outcome of the jackpot prize reel. A jackpot outcome is then determined by the ghost reel comparator 348 based on whether the propagated jackpot prize symbols displayed on the first and second ghost reels satisfy a defined condition, such as correspond to a line match of a given jackpot prize symbol. An applicable jackpot prize, if any, is awarded by the prize allocator 337 based on the line match FIG. 4C illustrates an example of a set 400 of five game reel strips 421, 422, 423, 424, 425 used during a base or feature game. In the example, each game reel strip has thirty-one reel strip positions 451-481. Each reel strip position of each reel has a symbol. For example, a "Wild" symbol 432 occupies the 13th reel position 413 of the fifth reel strip 425. Other reels strips to those illustrated in FIG. 4C can be used, for example reel strips that have up to one hundred reel strip positions. The actual length of the feature game reel strips would depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP), In this example, in addition to the WILD symbols 432, the symbols also include standard symbols 434, picture symbols 436, and scatter symbols 438 that correspond to trigger symbols. FIG. 4A illustrates an example ghost reel strip 426, with at least some reel strip positions each bearing a jackpot symbol 452, used when a symbol from the ghost reel strip 426 is selected for display. FIG. 4B illustrates an example jackpot prize reel strip 427, with at least some positions bearing jackpot prize symbols 454, 455, 456, and 457, used when a symbol from the jackpot prize reel strip 427 is selected for display.

Figure 5:
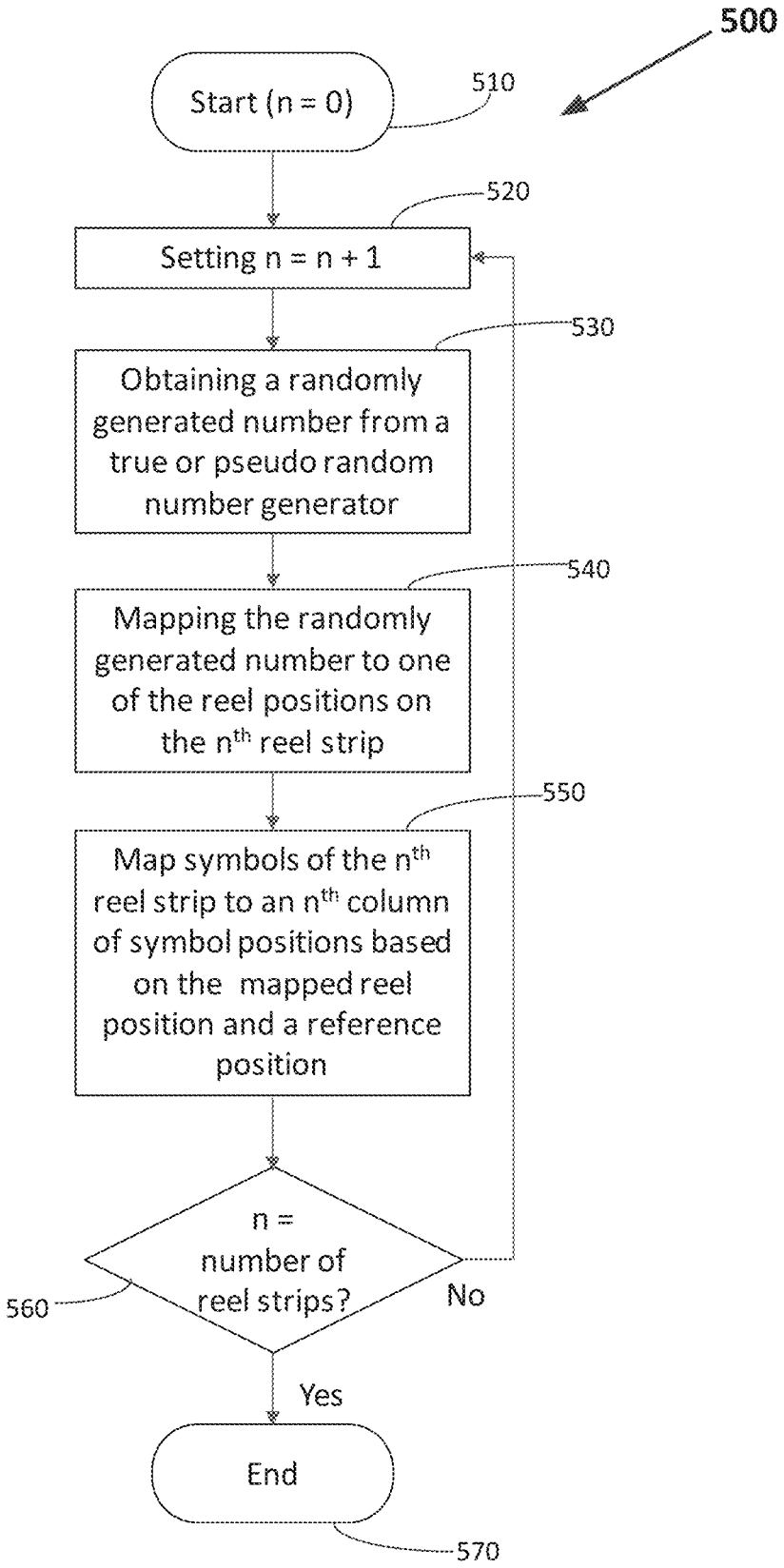
FIG. 5 is a flow chart of an example symbol selection operation implemented by a gaming device.

FIG. 5 is a flow chart of a method 500 carried out by the processor 204 to select symbols from reel strips, including one or more of the game reel strips, the ghost reel strip and the jackpot prize reel strip. At step 510, the processor 204 starts the process of selecting symbols with a counter (n) set at zero as symbols have not yet been selected from any reel strips. At step 520, the processor 204 increments the counter. In the first iteration, the counter is set to 1 to reflect that symbols are to be selected from a first reel strip. At step 530 the processor obtains a randomly generated number from a true or pseudo RNG 212. At step 540 the processor maps the generated number to one of the reel positions of the $n^{th}$ reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a lookup table. In one example, the ranges are each the same size so that each of the reel strip positions has the same chance of been selected. In other examples, the ranges may be arranged to weight the relative chances of selecting specific reel strip positions. The reel strips may be of different lengths.

At step 550, the processor 204 maps symbols of the nth reel strip to an nth column of symbol display positions based on the mapped reel position and a reference position. In this example, in the base game, 1<=n<=5 correspond to symbol selection from game reel strips 421-425 for display in the first column to the fifth columns, whereas n>5 correspond to symbol selection from the ghost reel strip 426 for additional display, such as overlaying or underlying the symbol selected from the game reel strips, in one or more associated column. In some examples, symbol selection from the ghost reel strips 426 is, from reel spin to reel spin, randomly activated (i.e. jackpot symbols can appear in a reel spin) or deactivated (i.e. no jackpot symbols can appear in a reel spin). In an example, the reference position is the bottom position of the symbol positions of each column of symbol positions. In this example, the selected reel position (and hence the symbol at this position) is mapped to the bottom symbol position of the column. In an example, there are two other symbol positions in the column of symbol positions and hence symbols at two neighboring reel strip positions are also mapped to the symbol positions of the column. Referring to the example reel strips of FIG. 4, if the value returned by the RNG 212 is mapped to reel position 413, then for the first reel strip 421, "J" symbol 442 is mapped to a bottom symbol position, "PIC2" symbol 444 is mapped to a middle symbol position, and "Q" symbol 446 is mapped to a top symbol position.

At step 560, the processor 204 determines whether symbols have been selected for all of the reel strips, and if not the processor reverts to step 520 and iterates through steps 530, 540 and 550 until it is determined at step 560 that symbols have been selected from all n reel strips and mapped to all n columns of symbol positions after which the symbol selection process ends 570. Different numbers of symbols may be mapped to different numbers of symbol positions.

After the symbols of all reel strips have been mapped to symbol positions, the processor 204 controls game display 240 to display them at the symbol positions of the symbol array.

Figure 6:
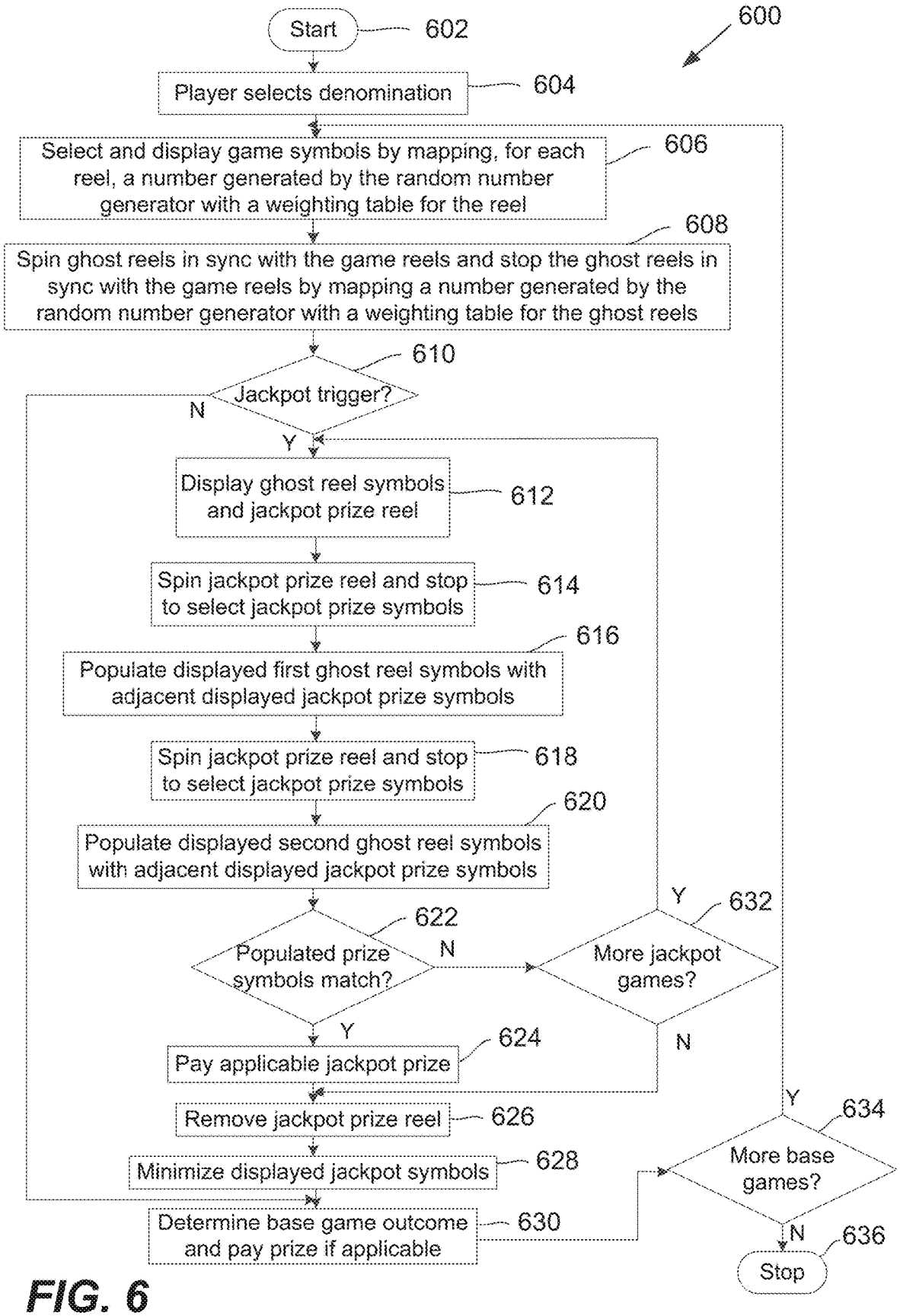
FIG. 6 is a flow chart illustrating an example gaming device operation that performs a ghost reel mechanic.

A flow chart 600 illustrates an example gaming device operation that performs a ghost reel mechanic. In one or more implementations, the flow chart 600 may be implemented by a game controller 202 shown in FIG. 3. The flow chart 600 can be implemented in a base game, feature game, and/or a jackpot feature. The use and discussion of FIG. 6 is only an example to facilitate explanation and is not intended to limit the disclosure to this specific example. For example, flow chart 600 does not necessarily need to perform the sequence of blocks in the order as depicted in FIG. 6. As an example, flow chart 600 may implement step 606 simultaneously with step 608 and/or in reverse order of what is shown in flow chart 600. Additionally, or alternatively, one or more of the blocks may be optional and may not be performed in all implementations of flow chart 600. In one example, step 604 may be not be implemented in other implementations of flow chart 600.

As shown, prior to implementation of a base game, a player first selects a denomination that will be used for bets during the base games, as indicated at step 604. In this example, the available denominations are 1 c, 2 c, 5 c, 10 c and $1, although it will be understood that any suitable denomination is envisaged.

Figure 7:
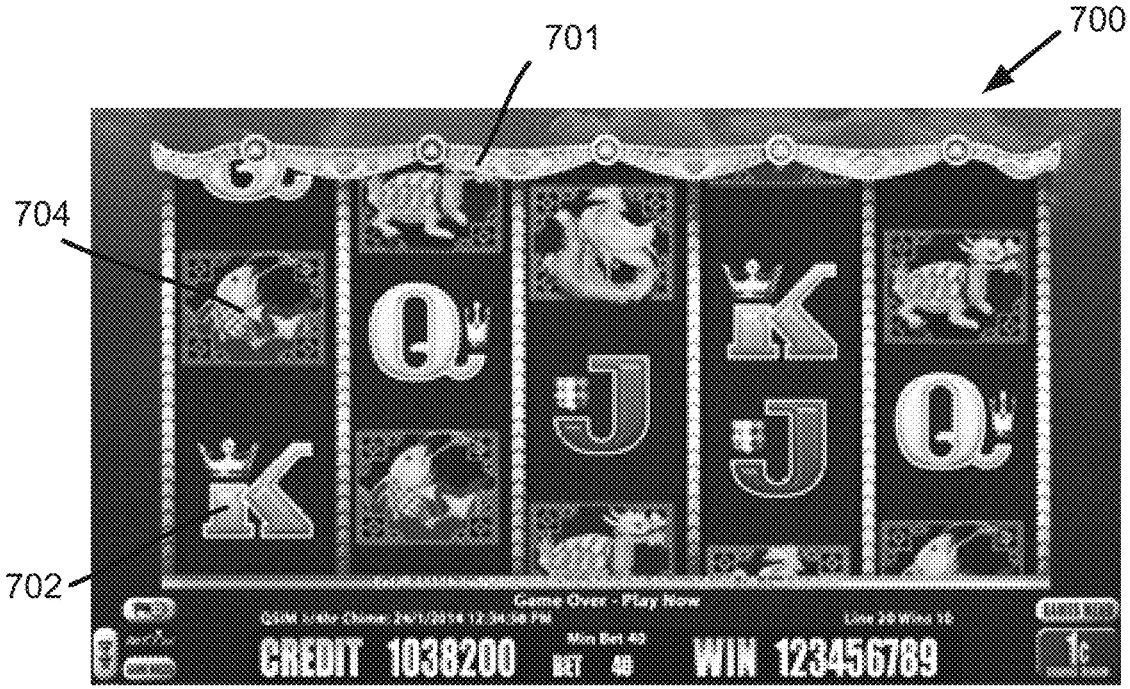
FIG. 7 is an example screenshot of a UI of a gaming device during implementation of a non-jackpot feature, such as a base game.

A UI 700 presented across one or more display screen of a gaming device during implementation of a non-jackpot feature (e.g., base game) is shown in FIG. 7. In FIG. 7, the UI 700 displays a 5×3 symbol display grid that has five columns and three rows. Each column in UI 700 represents a vertical reel that spins in a vertical direction. Each reel provides three symbol display position, one symbol display position in each row. Other implementations of UI 700 could utilize horizontal reels that spin in a horizontal direction.

After selection of the denomination, the selector 332 under control of the base game implementor 330 selects several symbols 310 using the random number generator process described in relation to FIGS. 4 and 5, and displays the selected symbols in a display area 701 on several base game reels, as indicated at step 606. In this example, the symbols 310 include standard symbols 702 and picture symbols 704.

Figure 8:
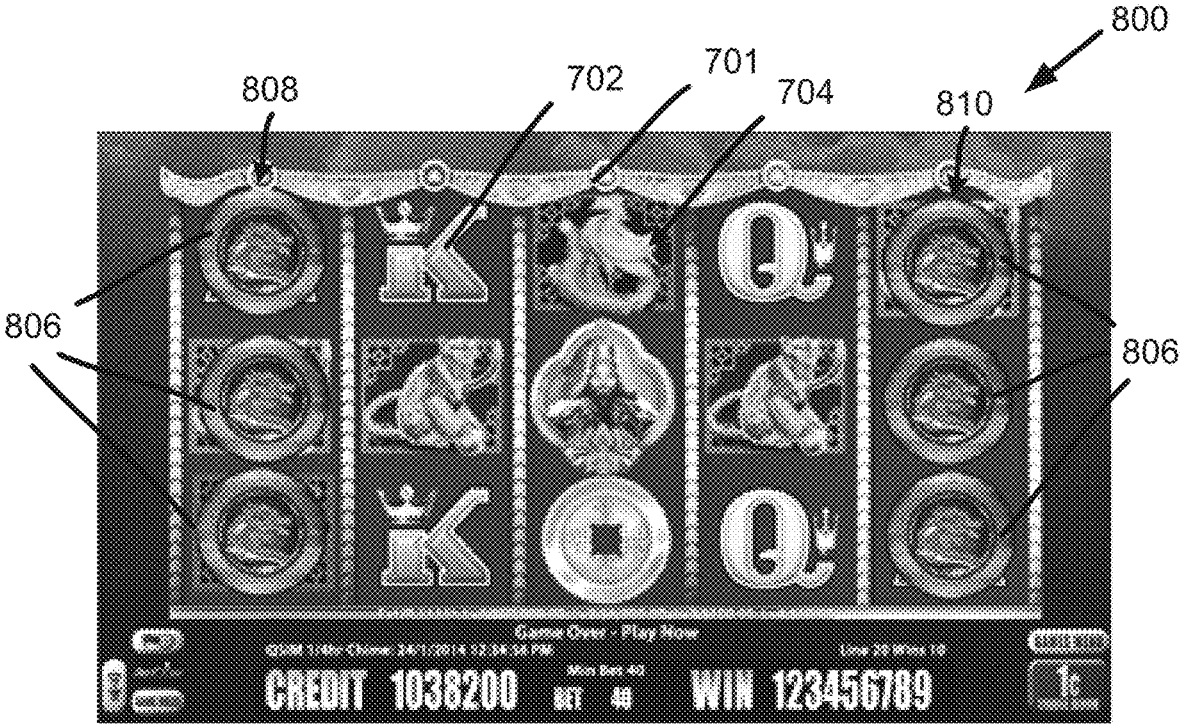
FIG. 8 is an example screenshot of a UI of a gaming device when a jackpot trigger condition exists.

In one or more implementations, a separate random event (e.g., based on a separate RNG outcome) occurs to determine whether to activate the ghost reels. If the ghost reels are activated, as indicated at step 608, as the base game reels spin, at least one ghost reel is also spun in synchronization with the base game reels such that each host reel is associated with a particular base game reel and jackpot symbols on the ghost reel are aligned with symbols on the associated base game reel. With reference to FIG. 4A, recall that each ghost reel represents a symbol group that includes jackpot symbols 452 and blank symbols 450. Each ghost reel can be synchronized with a base game reel in that the base game reel and the associated ghost reel are caused to spin at the same rate and stop at the same time. In this way, the ghost reel and therefore the mechanism for triggering a jackpot feature appear to be dependent on the base game outcome, even though the mechanism for triggering a jackpot feature is independent of the base game reels. This allows the ghost reels to be applied in different features and/or games while utilizing the same trigger frequency of the jackpot feature As indicated at step 610, if the reel stops of the ghost reel(s) 808, 810 generates a random based game outcome that satisfies a trigger condition, a jackpot feature is implemented. In the present example, as shown in FIG. 8, two ghost reels 808, 810 are provided and a jackpot trigger condition that includes the selection of a matching number of jackpot symbols 806 from the ghost reels 808, 810 for additional display in their associated columns in the display area 701. In one or more implementations, the ghost reels 808, 810 may need to land on a total of six jackpot symbols 806 to satisfy the jackpot trigger condition. As shown in FIG. 8, UI 800 depicts a symbol group displayed as overlaid symbols in each of the first column (e.g., reel one) and the fifth column in the display area 701 (e.g., reel five) that produces total of six jackpot symbols 806 to trigger a jackpot feature. It will be understood that any pattern of the jackpot symbols 806 may be used to trigger the jackpot feature. The jackpot symbols 806 correspond to the jackpot symbols 452 shown in FIG. 4A. If the ghost reels 808, 810 fail to trigger the jackpot feature, the ghost reels will deactivate and shrink, minimize, and/or be removed from UI 800.

Figure 9:
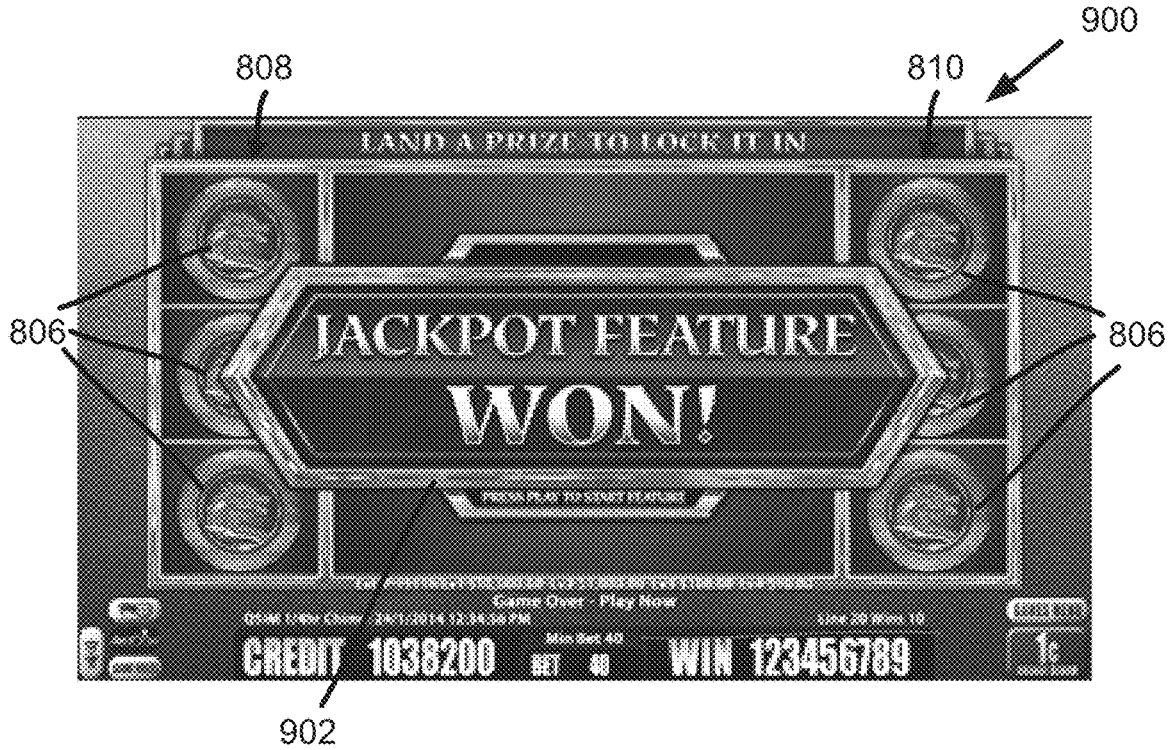
FIG. 9 is an example screenshot of a UI of a gaming device after triggering a jackpot feature.

If a jackpot trigger exists, a jackpot feature commences and a jackpot feature UI 900 is displayed, as shown in FIG. 9. Prior to commencement of a jackpot feature, a jackpot feature banner 902 is displayed to indicate to the player that a jackpot feature has triggered.

Figure 10:
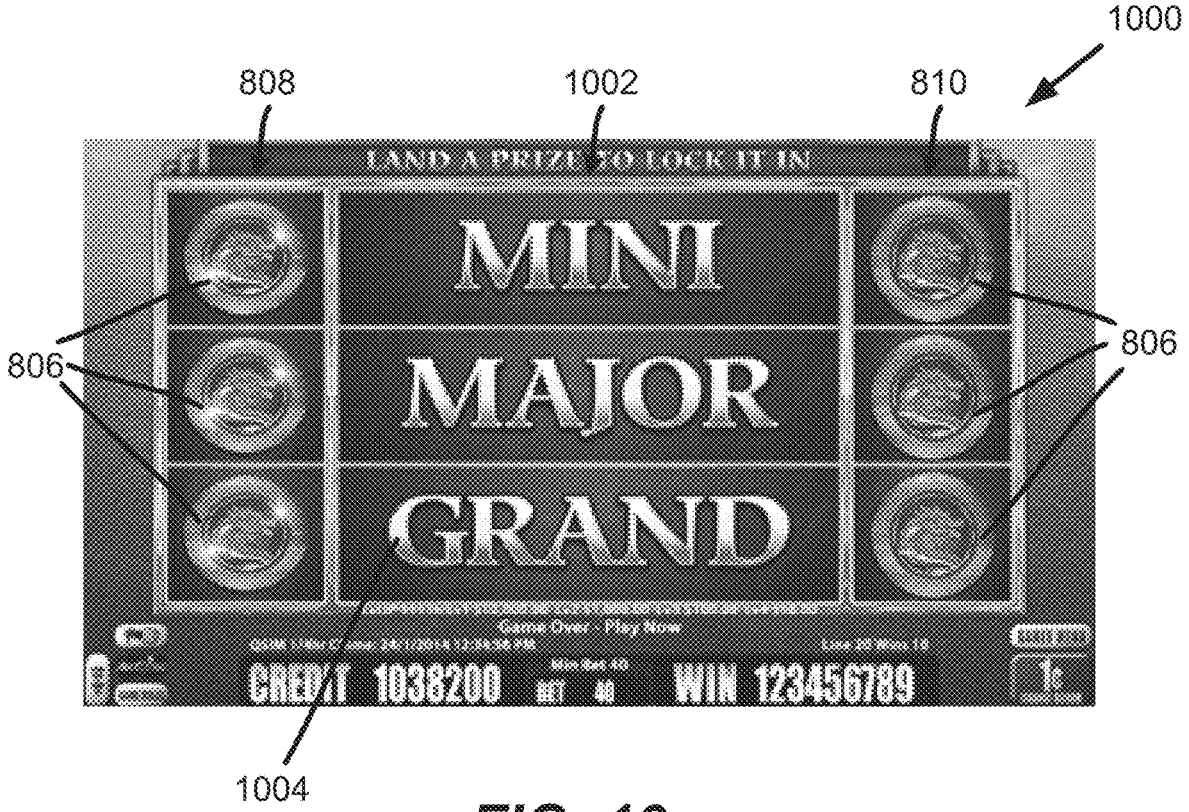
FIGS. 10 to 16 are example screenshots of UIs of a gaming device when implementing a jackpot feature.

FIG. 10 illustrates that jackpot feature UI 1000 presents a jackpot feature that is a different game type than the base game shown in UI 700 and 800. As shown in the jackpot feature UI 1000 in FIG. 10, the ghost reel outcomes, including the jackpot symbols 806, remain displayed in their associated columns in the jackpot feature together with a jackpot prize reel 1002. The jackpot prize reel 1002 is populated, via a similar method illustrated in FIG. 5, by symbols selected from the jackpot prize reel strip 427 that includes at least one jackpot prize symbol corresponding to each available jackpot prize, in this example MINI, MINOR, MAJOR and GRAND, as indicated at step 612. In this example, the jackpot prize reel 1002 is displayed as an enlarged column combining the second, third and fourth columns of the display area 701 shown in FIG. 8. The underlying symbols selected from the game reels cease to be displayed. In other implementations, instead of a single jackpot prize reel 1002, the jackpot feature UI 1000 could include multiple jackpot prize reels 1002. For example, instead of enlarging the jackpot prize reel 1002, separate prize reels could be placed in the third and fourth columns of the display area 701 shown in FIG. 8.

Figure 11:
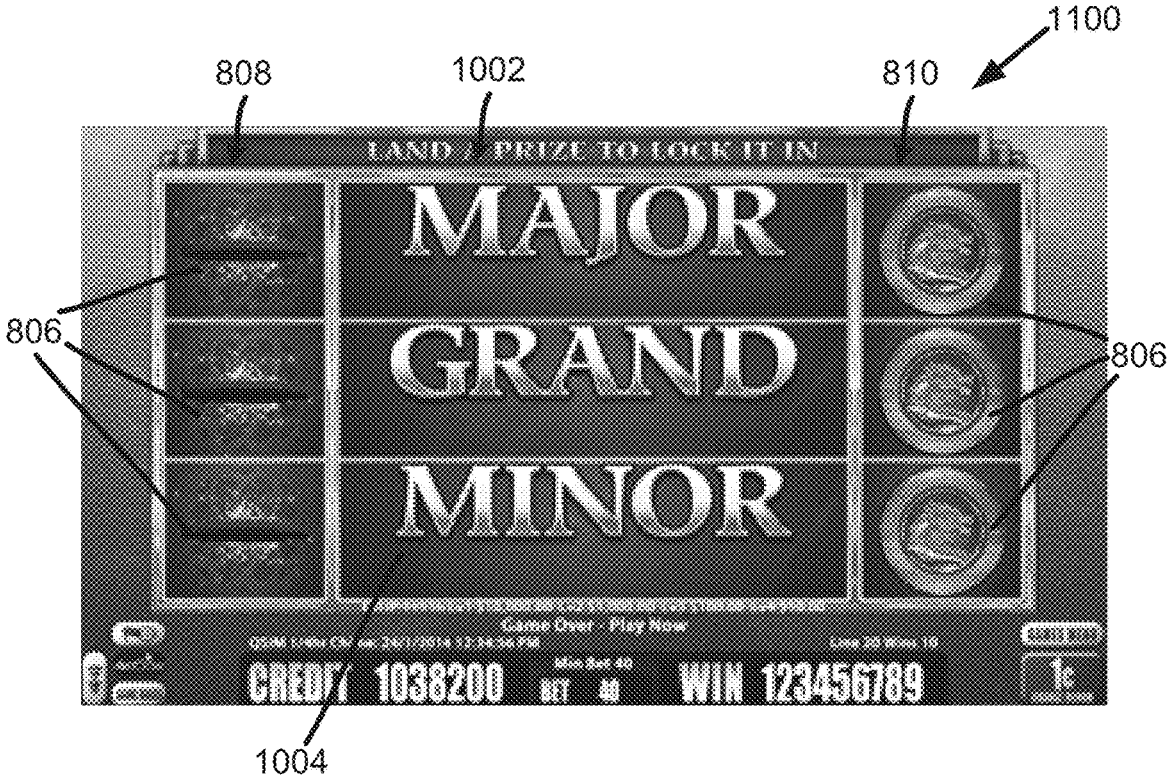
Figure 12:
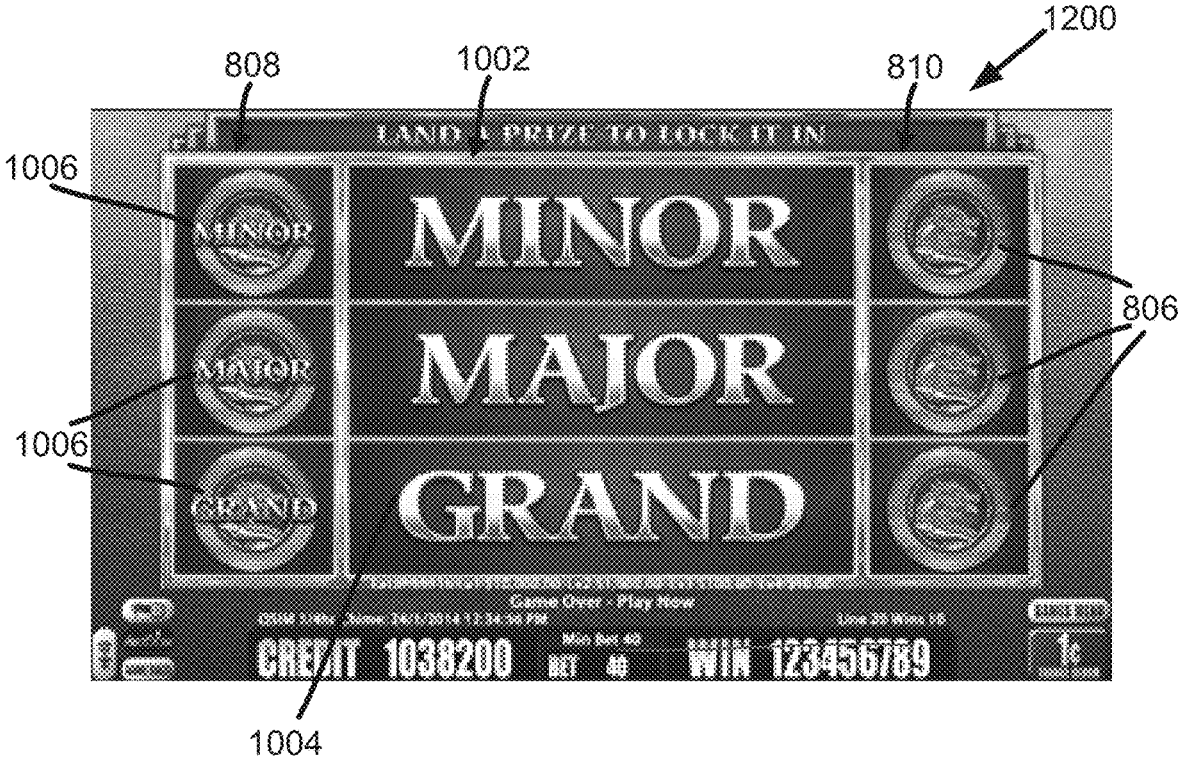

As indicated at step 614 and shown in FIGS. 10-12, the jackpot prize reel 1002 is then caused to spin and stop to thereby select jackpot prize symbols 1004 using a random number generator process. FIGS. 10-12 illustrate that after the reel stop, the jackpot prize reel 1002 displays three jackpot prize symbols 1004 located at three jackpot prize reel display positions of the jackpot prize reel 1002. The jackpot prize symbols 1004 displayed at the jackpot prize reel display positions represent the selected jackpot prize symbols 1004 that are propagated to jackpot symbols 806 of the first ghost reel 808. With reference to FIG. 3, the ghost reel populator 346 populates each jackpot symbol 806 of the first ghost reel 808 with jackpot prize symbol 1004 displayed adjacent to the jackpot symbol 806, as indicated at step 616. After receiving a jackpot prize symbol, each jackpot symbol 806 of the column associated with the first ghost reel 808 is updated, replaced, and/or populated with the propagated jackpot prize symbol 1006 shown in jackpot feature UI 1200 in FIG. 12.

Figure 13:
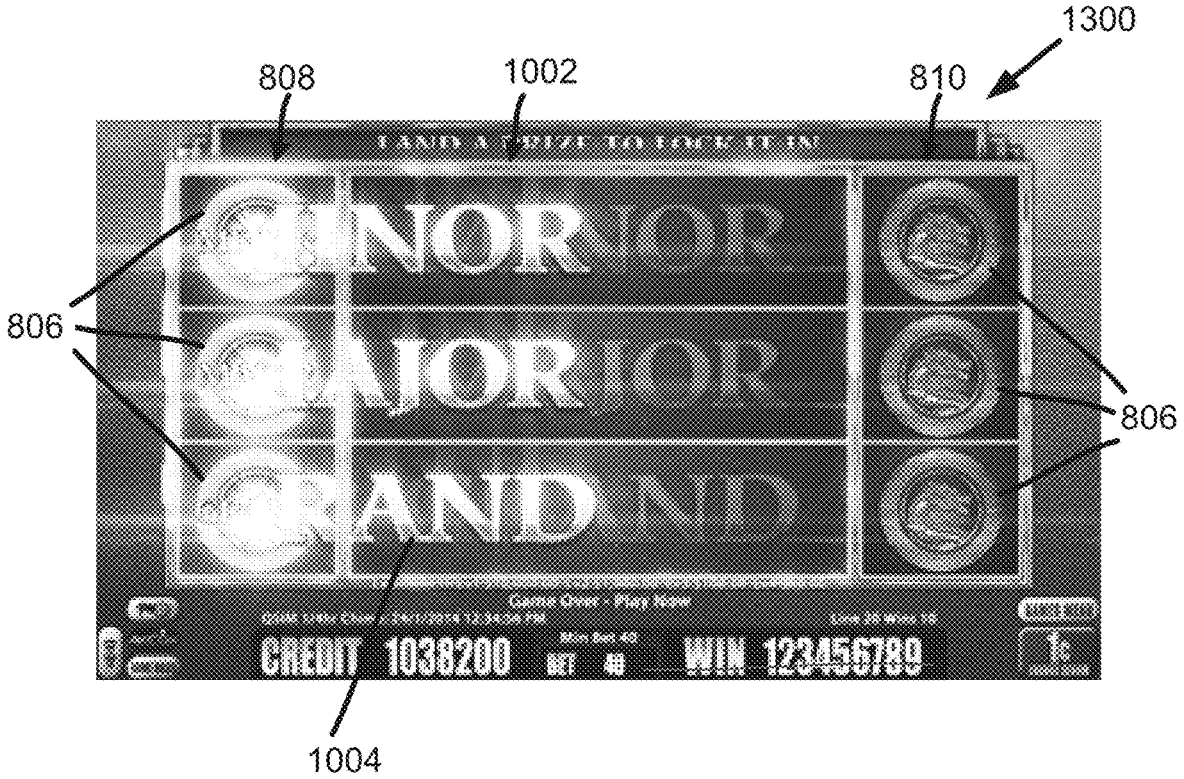

In the present example, the jackpot symbols 806 on the column associated with first ghost reel 808 are caused to animate as the jackpot prize reel 1002 spins, for example by causing the jackpot symbols 806 to individually spin, as shown in jackpot feature UI 1100 in FIG. 11. In FIG. 13, jackpot feature UI 1300 depicts the jackpot prize symbols 1004 are caused to animate, for example, by providing the appearance of moving from the jackpot prize reel 1002 to the column associated with the first ghost reel 808. During the animation, the selected jackpot prize symbols 1004 replace, populate, and/or update the jackpot symbols 806 to generate propagated jackpot prize symbol 1006.

Figure 14:
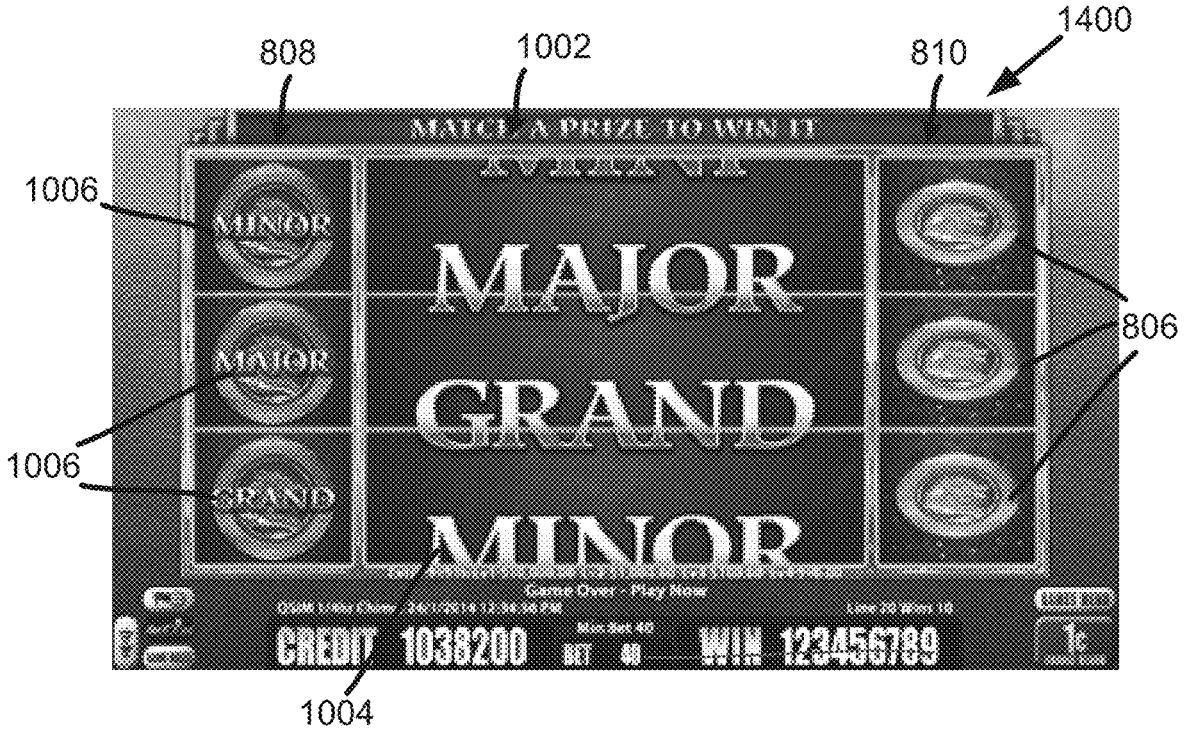
Figure 15:
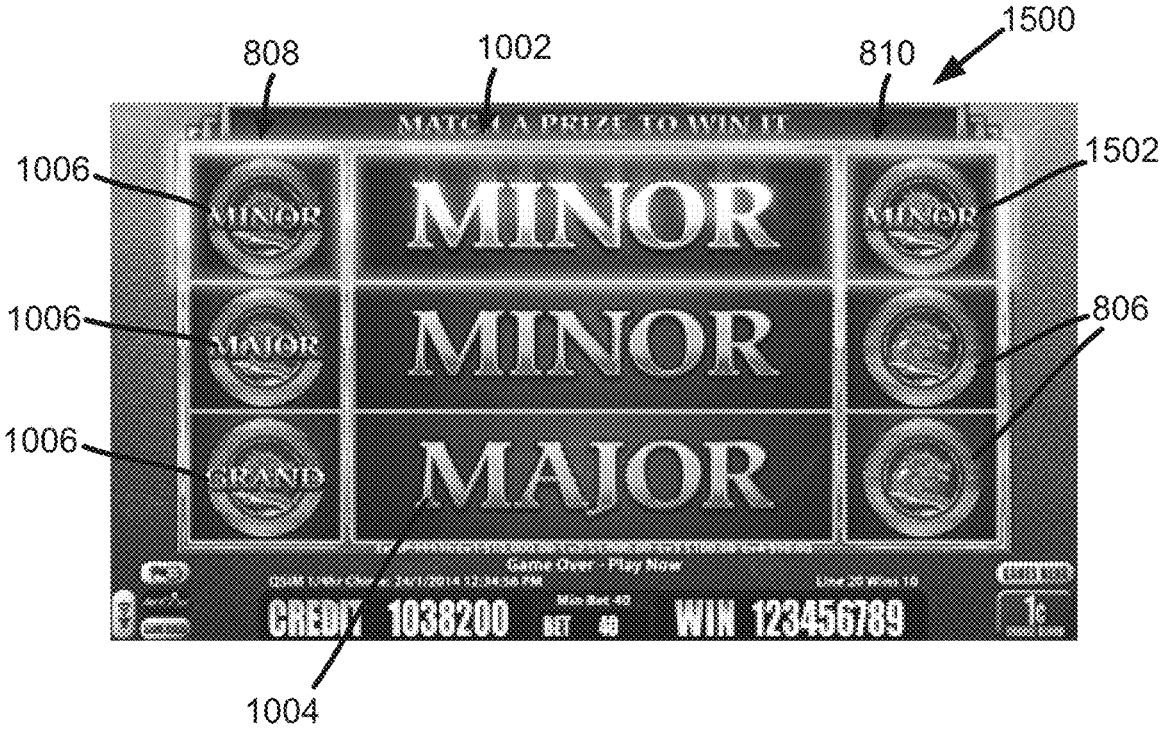

As indicated at step 618 and shown in FIGS. 14 and 15, the jackpot prize reel 1002 is again caused to spin and stop to thereby select further jackpot prize symbols 1004 using a random number generator process. Jackpot prize symbols 1004 determined for the reel stop are presented at the jackpot prize reel display positions. The selected jackpot prize symbol 1004 for the subsequent spin is used to updated, replaced, and/or populate an adjacent jackpot symbol 806 as a propagated jackpot prize symbol 1502. In one or more implementations, propagated jackpot prize symbols 1502 are populated when the selected jackpot symbol 1004 matches the propagated jackpot prize symbol 1006 displayed on the jackpot symbol 806 of the column associated with the first ghost reel 808. In other implementations, the jackpot prize symbols 1004 of the jackpot prize reel 1002 are propagated over to the second ghost reel 810 regardless of whether a match occurs with the first ghost reel 808.

In a variation, all further selected jackpot prize symbols 1004 are added to the jackpot symbols 806 of the column associated with the second ghost reel 810 by the ghost reel populator 346 such that each jackpot symbol 806 of the column associated with the second ghost reel 810 receives the jackpot prize symbol 1004 displayed adjacent the jackpot symbol 806, as indicated at step 620. After receiving a jackpot prize symbol 1004, each jackpot symbol 806 of the column associated with the second ghost reel 808 is updated, replaced, and/or populated with a propagated jackpot prize symbol 1502.

Figure 16:
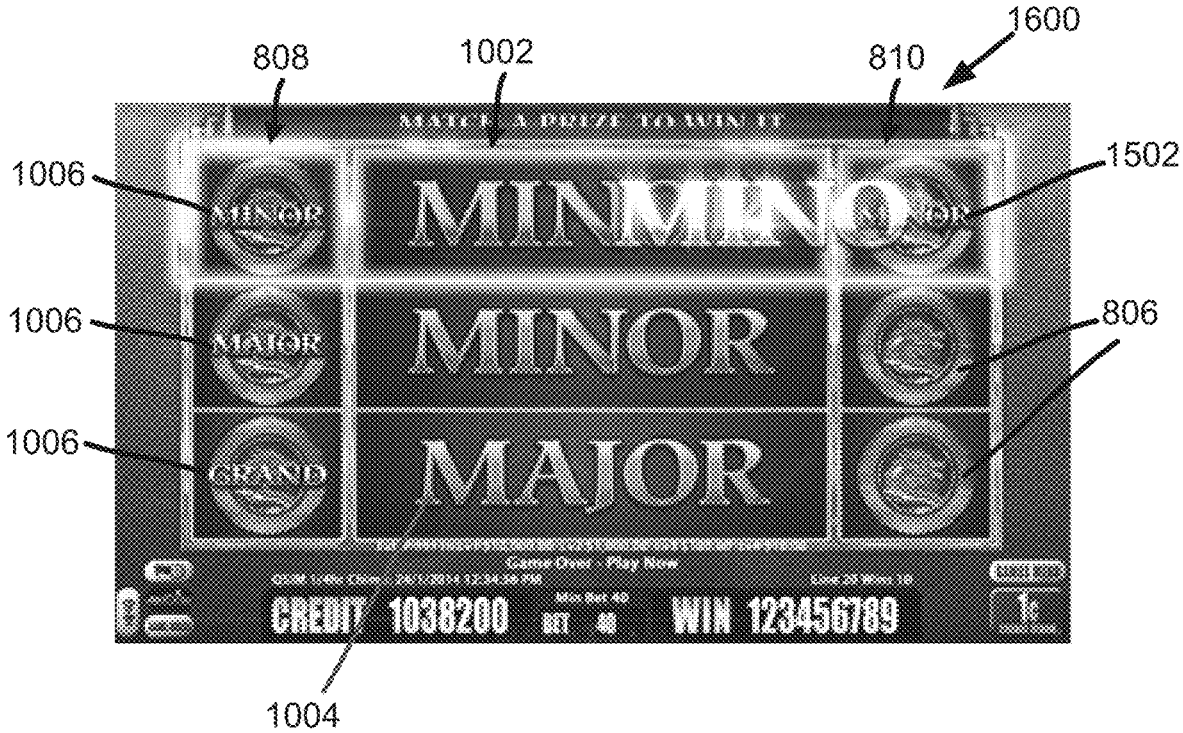

In the present example, the jackpot symbols 806 on the column associated with second ghost reel 808 are caused to animate as the jackpot prize reel 1002 spins, for example by causing the jackpot symbols 806 to individually spin, as shown in jackpot feature UI 1400 in FIG. 14. The jackpot prize symbols 1004 are caused to animate, for example by providing the appearance of moving from the jackpot prize reel 1002 to the column associated with the second ghost reel 808 as the selected jackpot prize symbols 1004 are used to update, replace, and/or populate the jackpot symbols 806, as shown in jackpot feature UI 1600 in FIG. 16.

As indicated at step 622, if the populated jackpot prize symbols on the same line match, a jackpot prize corresponding to the matched propagated jackpot prize symbols 1006, 1502 is awarded to the player. Using FIG. 15 as an example, jackpot feature UI 1500 depicts that a MINOR propagated jackpot prize symbol 1006 and a MINOR propagated jackpot prize symbol 1502 are displayed in the same line on both the first and second ghost reels 808, 810 to generate a line match. Based on the line match, a jackpot prize corresponding to the MINOR jackpot is awarded to the player, as indicated at step 624. In other examples, multiple matched jackpot prizes could be displayed in the respective lines to cause an award of multiple jackpot prizes. For purposes of this the disclosure, the term "line match" refers to when a random based game outcome generates a line of symbols that have the same symbol type. In one or more implementations, the line can correspond to a vertical line, a horizontal line, a diagonal line, and/or a zigzag line, Using FIGS. 14-16 as an example, the line match shown corresponds to a horizontal line match for the MINOR jackpot prize symbol 1004.

As indicated at steps 622 and 632, if the jackpot feature does not produce matching jackpot prize symbols on the first and second ghost reels, a determination is made as to whether any further jackpot features are available. If at least one further jackpot feature is available, the jackpot feature game process recommences from step 612.

Figure 17:
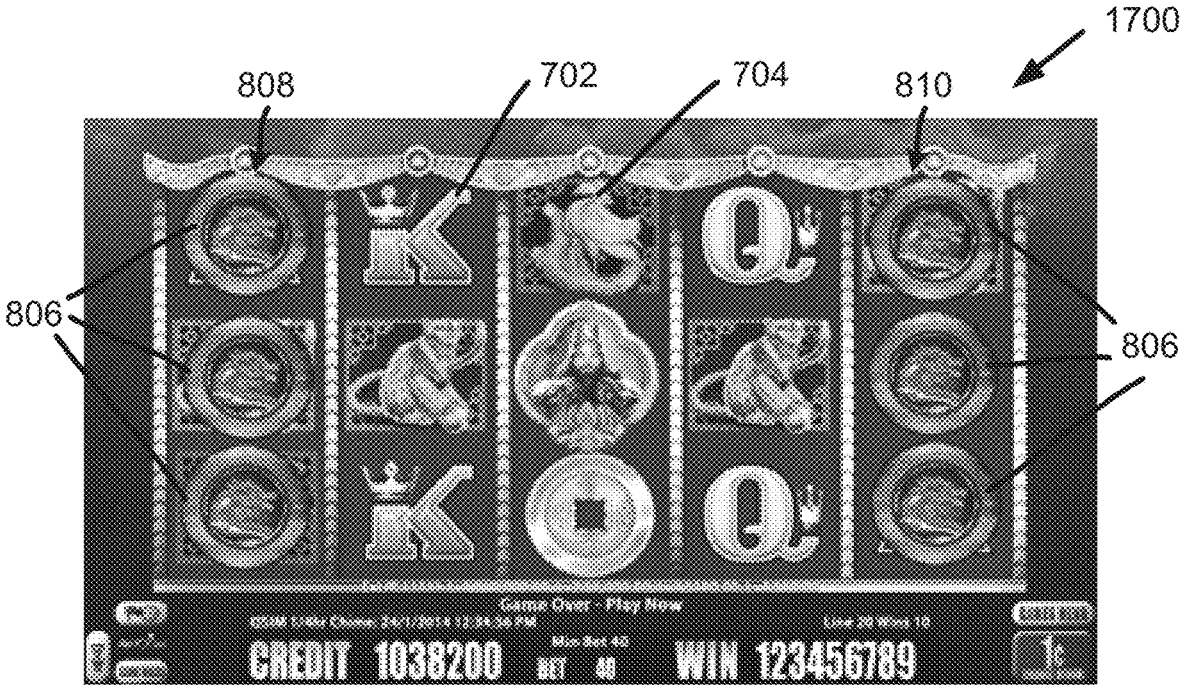
FIGS. 17 and 18 are example screenshots of UIs of a gaming device aftercompletion of a jackpot feature.

After a jackpot prize has been awarded or after all available jackpot features have been completed, the jackpot prize reel 1002 is removed and the display reverts to the base game screen 700 as shown in FIG. 17, as indicated at step 626.

Figure 18:
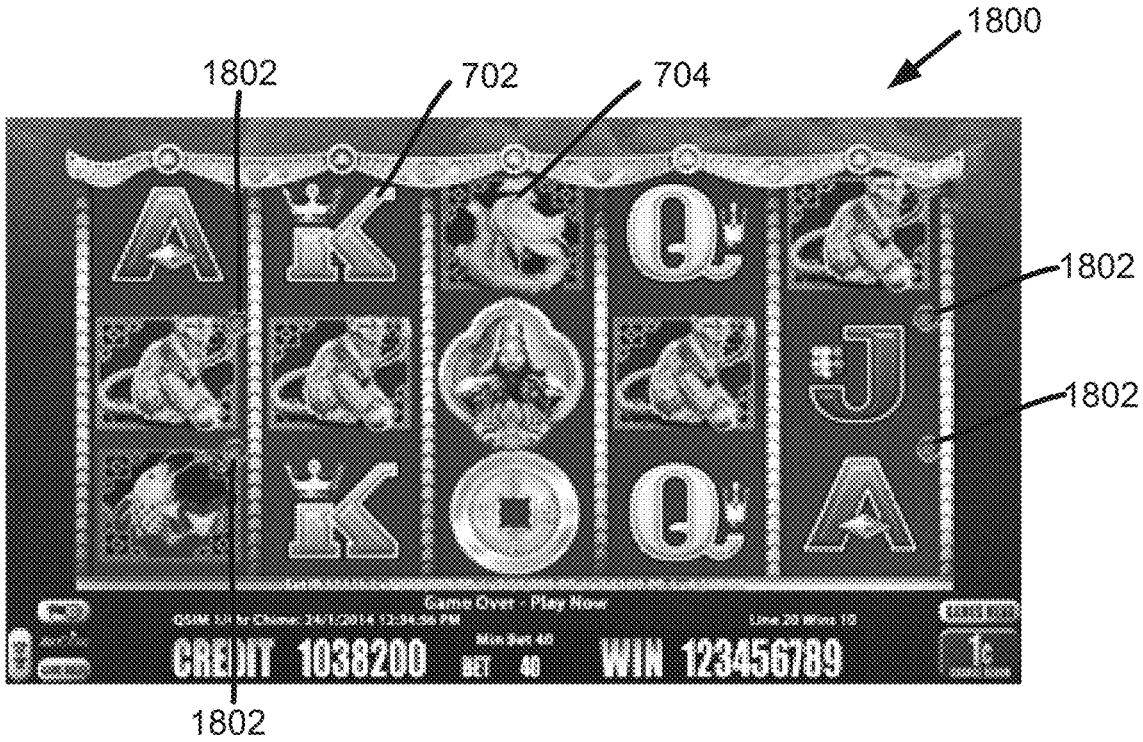

As shown in FIG. 18 and indicated at step 628, the jackpot symbols 806 are then replaced with minimized jackpot symbols 1802, and the outcome of the base game determined, as indicated at step 630.

As indicated at steps 634 and 636, if more base games are available the game process reverts to step 606, otherwise the process stops.

Alternatives and Variations

Numerous embodiments are described in this disclosure and are presented for illustrative purposes only. The described embodiments are not, and are not intended to be, limiting in any sense. As an example, although the disclosure generally describes the ghost reel mechanic in a Class 1H reel or slot game context the disclosure is not limited to this type of game and/or gaming device. For example, other implementations and/or portions of the ghost reel mechanic may be implemented as a Class H gaming device. In particular, a gaming device may present UIs 700-1500 while implementing a Class II bingo game. Additionally, or alternatively, portions of the ghost reel mechanic can be utilized for other types of wagering games, such as keno, lottery, and pachinko.

The present disclosure is widely applicable to numerous embodiments, as is readily apparent from the disclosure. One of ordinary skill in the art will recognize that the innovations described herein may be practiced with various modifications and alterations, such as structural, logical, software, and electrical modifications. Although particular features of the innovations described herein may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the innovations described herein that must be present in all embodiments. The Title (set forth at the beginning of the first page of this disclosure) is not to be taken as limiting in any way as the scope of the disclosed embodiments. Headings of sections provided in this disclosure are for convenience only and are not to be taken as limiting the disclosure in any way.

When an ordinal number (such as "first," "second," "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget." Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

When a single device, component, structure, or article is described herein, more than one device, component, structure or article (whether or not they cooperate) may alternatively be used in place of the single device, component or article that is described.

Accordingly, the functionality that is described as being possessed by a device may alternatively be possessed by more than one device, component or article (whether or not they cooperate). [0148] Similarly, where more than one device, component, structure, or article is described herein (whether or not they cooperate), a single device, component, structure, or article may alternatively be used in place of the more than one device, component, structure, or article that is described. For example, a plurality of computer-based devices may be substituted with a single computer-based device. Accordingly, the various functionality that is described as being possessed by more than one device, component, structure, or article may alternatively be possessed by a single device, component, structure, or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

Devices that are in communication with each other need not be in continuous communication with each other, unless expressly specified otherwise. On the contrary, such devices need only transmit to each other as necessary or desirable and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the innovations described herein. Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the innovations described herein, and does not imply that the illustrated process is preferred.

Although a process may be described as including a plurality of steps, that does not indicate that all or even any of the steps are essential or required. Various other embodiments within the scope of the present disclosure include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the present disclosure include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise.

For the sake of presentation, the detailed description uses terms like "determine" and "select" to describe computer operations in a computer system. These terms denote operations performed by a computer and should not be confused with acts performed by a human being. The actual computer operations corresponding to these terms vary depending on implementation. For example, "determining" something can be performed in a variety of manners, and therefore the term "determining" (and like terms) can indicate calculating, computing, deriving, looking up (e.g., in a table, database or data structure), ascertaining, recognizing, and the like.

As used herein, the term "send" denotes any way of conveying information from one component to another component, and the term "receive" denotes any way of getting information at one component from another component. The two components can be part of the same computer system or different computer systems. The information can be passed by value (e.g., as a parameter of a message or function call) or passed by reference (e.g., in a buffer). Depending on context, the information can be communicated directly between the two components or be conveyed through one or more intermediate components. As used herein, the term "connected" denotes an operable communication link between two components, which can be part of the same computer system or different computer systems. The operable communication link can be a wired or wireless network connection, which can be direct or pass through one or more intermediate components (e.g., of a network). Communication among computers and devices may be encrypted to ensure privacy and prevent fraud in any of a variety of ways well known in the art.

It will be readily apparent that the various methods and algorithms described herein may be implemented by, e.g., appropriately programmed general-purpose computers and computing devices. Typically, a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer-readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium for performing the process. The apparatus that performs the process can include components and devices (e.g., a processor, input and output devices) appropriate to perform the process. A computer-readable medium can store program elements appropriate to perform the method.

The term "computer-readable medium" refers to any non-transitory storage or memory that may store computer-executable instructions or other data in a computer system and be read by a processor in the computer system. A computer-readable medium may take many forms, including but not limited to non-volatile storage or memory (such as optical or magnetic disk media, a solid-state drive, a flash drive, PROM, EPROM, and other persistent memory) and volatile memory (such as DRAM). The term "computer-readable media" excludes signals, waves, and wave forms or other intangible or transitory media that may nevertheless be readable by a computer.

The present disclosure provides, to one of ordinary skill in the art, an enabling description of several embodiments and/or innovations. Some of these embodiments and/or innovations may not be claimed in the present application but may nevertheless be claimed in one or more continuing applications that claim the benefit of priority of the present application. Applicants may file additional applications to pursue patents for subject matter that has been disclosed and enabled but not claimed in the present application.

The foregoing description discloses only exemplary embodiments of the present disclosure. Modifications of the above disclosed apparatus and methods which fall within the scope of the present disclosure will be readily apparent to those of ordinary skill in the art. For example, although the examples discussed above are illustrated for a gaming market, embodiments of the present disclosure can be implemented for other markets. The gaming system environment of the examples is not intended to suggest any limitation as to the scope of use or functionality of any aspect of the disclosure.

While the invention has been described with respect to the figures, it will be appreciated that many modifications and changes may be made by those skilled in the art without departing from the spirit of the invention. Any variation and derivation from the above description and figures are included in the scope of the present invention as defined by the claims. In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

In accordance with a first aspect of the present invention, there is provided a gaming system comprising: at least one display; a game controller that includes at least one processor and at least one memory device, wherein: the at least one processor, the at least one memory device, and the at least one display are operably connected; and the at least one memory device stores computer-readable instructions for controlling the at least one processor to implement a non-jackpot feature; trigger a jackpot feature including at least one jackpot feature in response to a triggering event occurring during the non-jackpot feature; and for each jackpot feature: select and display at least one jackpot prize symbol from a jackpot prize reel on at least one respective jackpot prize reel display position, the jackpot prize reel including a plurality of jackpot prize symbols, each jackpot prize symbol indicative of a jackpot prize; populate each selected jackpot prize symbol to a displayed first symbol group; select at least one further jackpot prize symbol from the jackpot reel for display on at least one respective jackpot prize reel display position; populate at least one further selected jackpot prize symbol to a displayed second symbol group; determine whether a jackpot winning condition exists based on a comparison of the jackpot prize symbols in the first and second symbol groups; and award a jackpot prize amount to a player when the determination is that a jackpot winning condition exists.

In an embodiment, the at least one memory device stores computer-readable instructions for controlling the at least one processor to: display at least one ghost reel display position for at least one jackpot ghost reel, each jackpot ghost reel including at least one jackpot symbol and a plurality of blanks; select a jackpot symbol or blank at each ghost reel display position; wherein selection and display of at least one jackpot symbol or blank is independent of non-jackpot feature outcomes; and wherein the triggering event comprises selection and display of a defined outcome at the ghost reel display positions of the at least one jackpot ghost reel.

In an embodiment, the at least one memory device stores computer-readable instructions for controlling the at least one processor to: display at least one ghost reel display position for each of a plurality of jackpot ghost reels; wherein the triggering event comprises selection and display of a defined outcome at the ghost reel display positions of the plurality of jackpot ghost reels.

In an embodiment, the triggering event comprises selection and display of a matching number of jackpot symbols at the ghost reel display positions of each of the plurality of jackpot ghost reels.

In an embodiment, the at least one memory device stores computer-readable instructions for controlling the at least one processor to: dispose each jackpot ghost reel over a game reel usable to determine non-jackpot feature outcomes.

In an embodiment, the size of the displayed jackpot symbols is reduced after completion of the jackpot feature so that a symbol on an underlying game reel is visible.

In an embodiment, the at least one memory device stores computer-readable instructions for controlling the at least one processor to: rotate each jackpot ghost reel in synchronization with a game reel.

In an embodiment, the at least one memory device stores computer-readable instructions for controlling the at least one processor to: stop each jackpot ghost reel in synchronization with stopping of a game reel.

In an embodiment, the jackpot symbols of the plurality of ghost reels that form part of the triggering event are retained and displayed during the jackpot feature, the ghost reel display positions of a first jackpot ghost reel corresponding to the first symbol group and the ghost reel display positions of a second jackpot ghost reel corresponding to the second symbol group.

In an embodiment, the at least one memory device stores computer-readable instructions for controlling the at least one processor to: populate each selected jackpot prize symbol to a ghost reel display position of a first jackpot ghost reel if the ghost reel display position of the first ghost reel includes a jackpot symbol; and populate a further selected jackpot prize symbol to a ghost reel display position of a second jackpot ghost reel if the ghost reel display position of the second ghost reel includes a jackpot symbol.

In an embodiment, the jackpot prize reel comprises a plurality of different jackpot prize symbols, each jackpot prize symbol indicative of a different jackpot prize.

In an embodiment, the at least one memory device stores computer-readable instructions for controlling the at least one processor to: select a plurality of jackpot prize symbols from the jackpot prize reel for display at a respective plurality of jackpot prize reel display positions.

In an embodiment, the at least one memory device stores computer-readable instructions for controlling the at least one processor to: populate all further selected jackpot prize symbols to the second symbol group.

In an embodiment, the at least one memory device stores computer-readable instructions for controlling the at least one processor to: populate a further selected jackpot prize symbols to the second symbol group if the determination will be that a jackpot winning condition exists based on a comparison of the jackpot prize symbols in the first and second symbol groups.

In an embodiment, the first and second symbol groups are disposed adjacent the jackpot prize reel and each jackpot prize reel display position of the jackpot prize reel is aligned with a display position of the first symbol group and with a display position of the second symbol group, and the at least one memory device stores computer-readable instructions for controlling the at least one processor to: populate each selected jackpot prize symbol to an aligned display position of the first symbol group; populate at least one further selected jackpot prize symbol to an aligned display position of the second symbol group; and determine whether a jackpot winning condition exists based on whether each populated jackpot prize symbol in the first symbol group matches a populated jackpot prize symbol in the second symbol group that is aligned with the populated jackpot prize symbol in the first symbol group.

In accordance with a second aspect of the present invention, there is provided a method of gaming comprising: implementing a non-jackpot feature; triggering a jackpot feature including at least one jackpot feature in response to a triggering event occurring during the non-jackpot feature; and for each jackpot feature: selecting and displaying at least one jackpot prize symbol from a jackpot prize reel on at least one respective jackpot prize reel display position; the jackpot prize reel including a plurality of jackpot prize symbols, each jackpot prize symbol indicative of a jackpot prize; populate each selected jackpot prize symbol to a displayed first symbol group; selecting at least one further jackpot prize symbol from the jackpot reel for display on at least one respective jackpot prize reel display position; populating at least one further selected jackpot prize symbol to a displayed second symbol group; determining whether a jackpot winning condition exists based on a comparison of the jackpot prize symbols in the first and second symbol groups; and awarding a jackpot prize amount to a player when the determination is that a jackpot winning condition exists.

In an embodiment, the method comprises: displaying at least one ghost reel display position for at least one jackpot ghost reel, each jackpot ghost reel including at least one jackpot symbol and a plurality of blanks; selecting a jackpot symbol or blank at each ghost reel display position; wherein selection and display of at least one jackpot symbol or blank is independent of non-jackpot feature outcomes; and wherein the triggering event comprises selection and display of a defined outcome at the ghost reel display positions of the at least one jackpot ghost reel.

In an embodiment, the method comprises: displaying at least one ghost reel display position for each of a plurality of jackpot ghost reels; wherein the triggering event comprises selection and display of a defined outcome at the ghost reel display positions of the plurality of jackpot ghost reels.

In an embodiment, the triggering event comprises selection and display of a matching number of jackpot symbols at the ghost reel display positions of each of the plurality of jackpot ghost reels.

In an embodiment, the method comprises disposing each jackpot ghost reel over a game reel usable to determine non-jackpot feature outcomes.

In an embodiment, the method comprises reducing the size of the displayed jackpot symbols after completion of the jackpot feature so that a symbol on an underlying game reel is visible.

In an embodiment, the method comprises rotating each jackpot ghost reel in synchronization with a game reel.

In an embodiment, the method comprises stopping each jackpot ghost reel in synchronization with stopping of a game reel.

In an embodiment, the method comprises retaining and displaying the jackpot symbols of the plurality of ghost reels that form part of the triggering event during the jackpot feature, the ghost reel display positions of a first jackpot ghost reel corresponding to the first symbol group and the ghost reel display positions of a second jackpot ghost reel corresponding to the second symbol group.

In an embodiment, the method comprises: populating each selected jackpot prize symbol to a ghost reel display position of a first jackpot ghost reel if the ghost reel display position of the first ghost reel includes a jackpot symbol; and populating a further selected jackpot prize symbol to a ghost reel display position of a second jackpot ghost reel if the ghost reel display position of the second ghost reel includes a jackpot symbol.

In an embodiment, the jackpot prize reel comprises a plurality of different jackpot prize symbols, each jackpot prize symbol indicative of a different jackpot prize.

In an embodiment, the method comprises selecting a plurality of jackpot prize symbols from the jackpot prize reel for display at a respective plurality of jackpot prize reel display positions.

In an embodiment, the method comprises populating all further selected jackpot prize symbols to the second symbol group.

In an embodiment, the method comprises populating a further selected jackpot prize symbols to the second symbol group if the determination will be that a jackpot winning condition exists based on a comparison of the jackpot prize symbols in the first and second symbol groups.

In an embodiment, the method comprises: disposing the first and second symbol groups adjacent the jackpot prize reel such that each jackpot prize reel display position of the jackpot prize reel is aligned with a display position of the first symbol group and with a display position of the second symbol group; populating each selected jackpot prize symbol to an aligned display position of the first symbol group; populating at least one further selected jackpot prize symbol to an aligned display position of the second symbol group; and determining whether a jackpot winning condition exists based on whether each populated jackpot prize symbol in the first symbol group matches a populated jackpot prize symbol in the second symbol group that is aligned with the populated jackpot prize symbol in the first symbol group.

In accordance with a third aspect of the present invention, there is provided a gaming system comprising: at least one display; a game controller that includes at least one processor and at least one memory device, wherein: the at least one processor, the at least one memory device, and the at least one display are operably connected; and the at least one memory device stores computer-readable instructions for controlling the at least one processor to: implement a first game of first type; trigger a second game of second type different to the first type in response to a triggering event occurring during the first game; display at least one ghost reel display position for at least one ghost reel, each ghost reel including at least one trigger symbol and a plurality of blanks; dispose each ghost reel over a game reel of the first game; rotate the at least one ghost reel in synchronization with rotation of a game reel of the first game; select a trigger symbol or blank at each ghost reel display position; wherein selection and display of at least one trigger symbol or blank is independent of outcomes of the first game; and wherein the triggering event comprises selection and display of a defined outcome at the ghost reel display positions of the at least one ghost reel.

In accordance with a fourth aspect of the present invention, there is provided a method of gaming comprising: implementing a first game of first type; triggering a second game of second type different to the first type in response to a triggering event occurring during the first game; displaying at least one ghost reel display position for at least one ghost reel, each ghost reel including at least one trigger symbol and a plurality of blanks; disposing each ghost reel over a game reel of the first game; rotating the at least one ghost reel in synchronization with rotation of a game reel of the first game; selecting a trigger symbol or blank at each ghost reel display position; wherein selection and display of at least one trigger symbol or blank is independent of outcomes of the first game; and wherein the triggering event comprises selection and display of a defined outcome at the ghost reel display positions of the at least one ghost reel.

What is claimed is:

1. A non-transitory computer-readable medium, readable by at least one processor and comprising instructions stored thereon to cause the at least one processor to:

implement a non-jackpot feature, wherein a non-jackpot feature interface comprises a first reel set, and wherein at least two reels of the first reel set are additionally associated with one or more ghost reels, wherein the one or more ghost reels rotate in synchronization with the at least two reels of the first reel set;

trigger a jackpot feature in response to a triggering event occurring during the non-jackpot feature, wherein the triggering event is based on an outcome of the one or more ghost reels;

select, based on a first random based game outcome, at least one jackpot prize symbol from a jackpot prize reel to be displayed on at least one respective jackpot prize reel display position, wherein the jackpot prize reel includes a plurality of jackpot prize symbols, each jackpot prize symbol indicative of a jackpot prize;

populate the at least one selected jackpot prize symbol to a first symbol group presented in association with a first reel of the at least two reels associated with the one or more ghost reels;

select, based on a second random based game outcome, at least one further jackpot prize symbol from the jackpot prize reel to be displayed on at least one respective jackpot prize reel display position;

populate the at least one further selected jackpot prize symbol to a second symbol group presented in association with a second reel of the at least two reels associated with the one or more ghost reels;

determine whether a line match condition exists based on a comparison of the jackpot prize symbols in at least the first symbol group and the second symbol group;

determine a jackpot prize amount based on the line match condition; and cause to be displayed the determined jackpot prize amount.

2. The non-transitory computer-readable medium of claim 1, wherein the instructions further cause the at least one processor to:

generate the first symbol group as a first ghost reel of the one or more ghost reels and the second symbol group as a second ghost reel of the one or more ghost reels in the non-jackpot feature, wherein the first ghost reel and the second ghost reel include at least one jackpot symbol;

generate a third random based game outcome that selects one or more jackpot symbols for the first ghost reel and the second ghost reel to trigger the jackpot feature, wherein the third random based game outcome is independent of a fourth random based game outcome generated from a set of reels in the non-jackpot feature; and transfer, in response to the triggering event, the selected jackpot symbols of the third random based game outcome to the jackpot feature.

3. The non-transitory computer-readable medium of claim 2, wherein the instructions further cause the at least one processor to:

cause to be displayed the first ghost reel and the second ghost reel in the jackpot feature; and cause to be displayed the selected jackpot symbols of the third random based game outcome within the first ghost reel and the second ghost reel in the jackpot feature.

4. The non-transitory computer-readable medium of claim 2, wherein a number of selected jackpot symbols satisfy the triggering event.

5. The non-transitory computer-readable medium of claim 2, wherein the instructions further cause the at least one processor to dispose the first ghost reel and the second ghost reel over one or more reels in the set of reels in the non-jackpot feature, wherein the fourth random based game outcome is indicative of a non-jackpot feature outcome.

6. The non-transitory computer-readable medium of claim 5, wherein the instructions further cause the at least one processor to rotate the first ghost reel and the second ghost reel in synchronization with the one or more reels in the set of reels after disposing the first ghost reel and the second ghost reel over the one or more reels in the set of reels.

7. The non-transitory computer-readable medium of claim 6, wherein the instructions further cause the at least one processor to stop the first ghost reel and the second ghost reel in synchronization with stopping the one or more reels in the set of reels.

8. The non-transitory computer-readable medium of claim 2, wherein the jackpot symbols displayed in the first ghost reel and the second ghost reel are reduced in size after completion of the jackpot feature so that one or more symbols of the set of reels are visible.

9. The non-transitory computer-readable medium of claim 1, wherein the first symbol group corresponds to a first ghost reel in the non-jackpot feature and the second symbol group corresponds to a second ghost reel in the non-jackpot feature, wherein the jackpot symbols of the first ghost reel and the second ghost reel that form part of the triggering event are retained and displayed during the jackpot feature.

10. The non-transitory computer-readable medium of claim 9, wherein the instructions further cause the at least one processor to:

populate each selected jackpot prize symbol to a ghost reel display position of the first ghost reel based on a determination that the ghost reel display position of the first ghost reel includes a jackpot symbol; and populate a further selected jackpot prize symbol to a ghost reel display position of the second ghost reel based on a determination that the ghost reel display position of the second ghost reel includes a jackpot symbol.

11. The non-transitory computer-readable medium of claim 1, wherein the jackpot prize symbols correspond to different jackpot prizes.

12. The non-transitory computer-readable medium of claim 1, wherein the line match condition represents a horizontal line of jackpot prize symbols that have the same symbol type.

13. The non-transitory computer-readable medium of claim 1, wherein the instructions further cause the at least one processor to:

populate all further selected jackpot prize symbols to the second symbol group.

14. The non-transitory computer-readable medium of claim 1, wherein the instructions further cause the at least one processor to:

determine that the at least one further selected jackpot prize symbol of the jackpot prize reel matches the at least one selected jackpot prize symbol populated for the first symbol group; and populate the at least one further selected jackpot prize symbol to the second symbol group based on a determination that the at least one further selected jackpot prize symbol of the jackpot prize reel matches the at least one selected jackpot prize symbol populated for the first symbol group.

15. The non-transitory computer-readable medium of claim 1, wherein the first and second symbol groups are disposed adjacent the jackpot prize reel and each jackpot prize reel display position of the jackpot prize reel is aligned with a display position of the first symbol group and with a display position of the second symbol group, and wherein the instructions further cause the at least one processor to:

populate the at least one selected jackpot prize symbol to an aligned display position of the first symbol group; and populate the at least one further selected jackpot prize symbol to an aligned display position of the second symbol group.

16. A method, comprising:

generating a non-jackpot feature for display including a set of reels associated with one or more ghost reels, wherein the one or more ghost reels rotate in synchronization with the set of reels;

triggering a jackpot feature in response to an event during the non-jackpot feature:

selecting, based on a first random based game outcome, at least one jackpot prize symbol from a jackpot prize reel that includes a plurality of jackpot prize symbols, wherein each jackpot prize symbol is indicative of a jackpot prize;

populating the at least one selected jackpot prize symbol to a first symbol group presented in association with at least one reel of the set of reels associated with the one or more ghost reels;

selecting, based on a second random based game outcome, at least one further jackpot prize symbol from the jackpot prize reel;

populating the at least one further selected jackpot prize symbol to a second symbol group presented in association with at least one further reel of the set of reels associated with the one or more ghost reels; and in response to a line match condition existing between the jackpot prize symbols in the first symbol group and the second symbol group, determining a jackpot prize amount for display based on the line match condition.

17. The method of claim 16, wherein the event is based on an outcome of the one or more ghost reels.

18. The method of claim 16, wherein the first symbol group corresponds to a first ghost reel in the non-jackpot feature and the second symbol group corresponds to a second ghost reel in the non-jackpot feature, wherein the jackpot symbols of the first ghost reel and the second ghost reel that form part of the event are retained and displayed during the jackpot feature.

19. A gaming system, comprising:

at least one display;

a game controller operably connected to the at least one display, wherein the game controller includes at least one processor and at least one memory device, wherein the at least one memory devices stores computer-readable instructions for controlling the at least one processor to:

implement a non-jackpot feature including a first reel set, wherein at least two reels of the first reel set are associated with at least two reels of a ghost reel set, wherein the at least two reels of the ghost reel set rotate in synchronization with the at least two reels of the first reel set;

in response to a triggering event occurring during the non-jackpot feature based on an outcome of the at least two reels of the ghost reel set, trigger a jackpot feature;

select, based on a first random based game outcome, a first jackpot prize symbol from a jackpot prize reel to be displayed on at least one respective jackpot prize reel display position, wherein the jackpot prize reel includes a plurality of jackpot prize symbols and each jackpot prize is indicative of a jackpot prize;

populate the first selected jackpot prize symbol to a first symbol group presented in association with a first reel of the at least two reels of the first reel set;

select, based on a second random based game outcome, a second jackpot prize symbol from the jackpot prize reel to be displayed on at least one respective jackpot prize reel display position;

populate the second selected jackpot prize symbol to a second symbol group presented in associated with a second reel of the at least two reels of the first reel set;

determine whether a line match condition exists based on a comparison of the jackpot prize symbols in at least the first symbol group and the second symbol group; and when the line match condition exists:

calculate a jackpot prize amount based on the line matched jackpot prize symbols; and display the jackpot prize amount.

20. The gaming system of claim 19, the processor further comprising instructions for controlling the at least one processor to:

determine that the second selected jackpot prize symbol of the jackpot prize reel matches the first selected jackpot prize symbol populated for the first symbol group; and populate the second selected jackpot prize symbol to the second symbol group based on a determination that the second selected jackpot prize symbol of the jackpot prize reel matches the first selected jackpot prize symbol populated for the first symbol group.

* * * * *